US010147998B2

(12) United States Patent
Kato et al.

(10) Patent No.: US 10,147,998 B2
(45) Date of Patent: Dec. 4, 2018

(54) INTERFACE AND COMMUNICATION DEVICE

(71) Applicant: Murata Manufacturing Co., Ltd., Nagaokakyo-shi, Kyoto-fu (JP)

(72) Inventors: Noboru Kato, Nagaokakyo (JP); Masahiro Ozawa, Nagaokakyo (JP); Nobuhito Tsubaki, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 15/898,243

(22) Filed: Feb. 16, 2018

(65) Prior Publication Data

US 2018/0175482 A1 Jun. 21, 2018

Related U.S. Application Data

(63) Continuation of application No. 14/674,097, filed on Mar. 31, 2015, now Pat. No. 9,935,358, which is a continuation of application No. PCT/JP2013/079229, filed on Oct. 29, 2013.

(30) Foreign Application Priority Data

Nov. 28, 2012 (JP) ..... 2012-259739

(51) Int. Cl.

| | |
|---|---|
| ***H01Q 1/22*** | (2006.01) |
| ***H01Q 1/24*** | (2006.01) |
| ***H01Q 7/06*** | (2006.01) |
| ***H01Q 7/00*** | (2006.01) |
| ***H01Q 1/52*** | (2006.01) |

(52) U.S. Cl.

CPC ..... *H01Q 1/241* (2013.01); *H01Q 1/22* (2013.01); *H01Q 1/243* (2013.01); *H01Q 1/526* (2013.01); *H01Q 7/00* (2013.01); *H01Q 7/06* (2013.01)

(58) Field of Classification Search

CPC .. H01Q 1/24; H01Q 1/22; H01Q 1/52; H01Q 7/00; H01Q 7/06

USPC ..... 343/702

See application file for complete search history.

(56) References Cited

U.S. PATENT DOCUMENTS

2010/0309081 A1* 12/2010 Kobayashi ..... G06K 7/10316 343/788

2011/0011935 A1* 1/2011 Takahashi ..... G06K 7/0008 235/439

OTHER PUBLICATIONS

Kato et al., "Interface and Communication Device", U.S. Appl. No. 14/674,097, filed Mar. 31, 2015.

* cited by examiner

*Primary Examiner* — Andrea Lindgren Baltzell

(74) *Attorney, Agent, or Firm* — Keating & Bennett, LLP

(57) ABSTRACT

An antenna of a communication terminal is disposed on a side on which a bottom surface of a reflective plate, which is included in a display, is present. When the reflective plate is irradiated by an LED light source, the antenna cannot be seen from the side on which a display screen of the display is disposed. Accordingly, an antenna coil of the antenna does not need transparent electrodes and can be made of various materials each having a high conductivity. Therefore, the antenna has high sensitivity, low manufacturing cost, and very efficiently performs near field communication with an external device located on the display screen side of the display.

18 Claims, 20 Drawing Sheets

INTERFACE AND COMMUNICATION DEVICE

BACKGROUND OF THE INVENTION

1. Field of the Invention

The present invention relates to an interface and a communication device.

2. Description of the Related Art

Communication terminals, representative examples of which are cellular phones, have recently had functions equivalent to those of personal computers as a result of advances in processors. In particular, a communication terminal that is provided with a graphical user interface (GUI) can provide a user with an interface for applications. Therefore, such a communication terminal is expected to be used in near field communication conforming to the near field communication (NFC) standard other than being used as a telephone.

In the related art, in order to perform near field communication, an antenna that is disposed on a rear surface side of a communication terminal needs to be brought close to an external device with which the communication terminal communicates. Thus, a mark that indicates the position of the antenna is provided on the rear surface of the communication terminal.

However, in the case where a cover or the like that is made of a silicone rubber is mounted on the communication terminal, the mark, which indicates the position of the antenna, cannot be visually recognized from the outside. In addition, in the case where a housing of the communication terminal is made from a metal such as aluminum or stainless steel, there are disadvantages in that an area in which the communication terminal can perform communication may sometimes be small and there is a possibility that the communication terminal cannot perform communication. In the case of trying to read information that is recorded on an IC card by using a relatively large communication terminal such as a tablet terminal, it would be convenient if near field communication can be performed on a front surface side of the communication terminal.

Accordingly, a technology for realizing near field communication performed on a front surface side of a communication terminal has been proposed (see, for example, Japanese Unexamined Patent Application Publication No. 2006-195802). A reader-writer disclosed in Japanese Unexamined Patent Application Publication No. 2006-195802 includes an antenna that is superposed with a display screen of a liquid crystal panel. Thus, the reader-writer can communicate with a device or an IC card located on a front surface side of the liquid crystal panel with good efficiency.

The antenna of the reader-writer disclosed in Japanese Unexamined Patent Application Publication No. 2006-195802 is formed by depositing a transparent conductive material on a transparent substrate, which is superposed with the liquid crystal panel, by sputtering and by performing patterning of the transparent conductive material. Thus, the degree of freedom when designing the antenna is smaller than that when designing a versatile antenna. In the case where an antenna is formed by the above method, an antenna coil is formed when a display is manufactured. Consequently, in the case where a design change is made in a housing in which the display is to be accommodated after the display has been manufactured, and where the antenna characteristics deteriorate, it becomes difficult to address the deterioration.

Indium tin oxide (ITO) is often used as the transparent conductive material. However, the conductivity of ITO is one hundredth or less than the conductivity of copper, aluminum, silver, or the like. Thus, it is difficult to obtain a sufficient Q value by using an antenna that includes a coil made of ITO, and there is a problem in that communication quality becomes inconsistent.

SUMMARY OF THE INVENTION

Preferred embodiments of the present invention efficiently perform communication with a device that is located on a side on which a display screen of a display device is present while ensuring a sufficient degree of freedom when designing an antenna.

An interface according to a first aspect of various preferred embodiments of the present invention includes a display device that uses a matrix driving method and includes a display screen, which displays information, on a first side of the display device, a shield plate that is disposed on a second side of the display device, and an antenna coil that is disposed between the display device and the shield plate.

The antenna coil preferably is not exposed when viewed from a side on which the display screen of the display device is disposed.

The display device preferably includes a light source.

The interface preferably includes a magnetic sheet that is disposed between the antenna coil and the shield plate.

The antenna coil preferably is configured to generate a magnetic flux that crosses the display screen.

The interface preferably includes a magnetic member that extends through the antenna coil in a direction in which the display screen extends.

The interface preferably includes a spacer that is used to eliminate a difference in level between the antenna coil and the magnetic member.

The antenna coil preferably is configured to generate a magnetic flux that is parallel or substantially parallel to the display screen.

The interface preferably includes a plurality of the antenna coils.

The interface preferably includes a touch panel that is superposed with the display screen.

The touch panel preferably is an electrostatic capacitive touch panel.

The interface preferably includes a floating electrode that is disposed in at least one of a region around an outer periphery of the antenna coil and a region in an opening of the antenna coil.

The interface preferably includes an insulating portion that is positioned between the antenna coil and the shield plate or between the antenna coil and the display device.

The magnetic sheet preferably is disposed at a position that is superposed with a region in which the antenna coil is provided when viewed in plan.

A communication device according to a second aspect of various preferred embodiments of the present invention includes the interface according to the first aspect of various preferred embodiments of the present invention and a communication unit that communicates with an external device via the antenna coil, which is included in the interface.

The communication unit preferably is configured to perform near field communication with the external device.

An antenna coil preferably is disposed on the side opposite to the side on which a display screen of a display device, which uses a matrix driving method, is disposed. Thus, the shape of the antenna coil is not limited due to the relationship with the display device. Therefore, the degree of freedom when designing an antenna is increased. In addition, the antenna coil, which is disposed on the side opposite to the side on which the display screen is disposed, cannot be seen from the side on which the display screen is disposed. Thus, a material other than a conductive material is able to be used as the material out of which the antenna coil is made. Therefore, the antenna coil is able to be made of copper, aluminum, or the like having a high conductivity, and thus, the antenna having a high sensitivity is able to be manufactured at low cost. As a result, communication is efficiently performed with a device that is located on the side on which the display screen of the display device is disposed while ensuring the degree of freedom when designing the antenna.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Various preferred embodiments of the present invention will be described below with reference to the drawings. In the description, an XYZ coordinate system that is defined by an X axis, a Y axis, and a Z axis, which are perpendicular to one another, is used for convenience of description.

Figure 1:
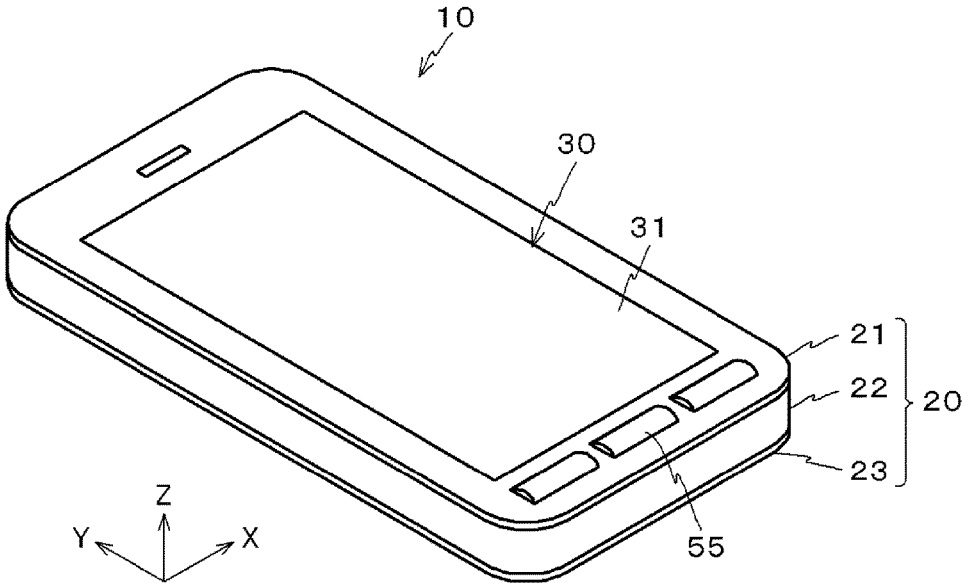
FIG. 1 is a perspective view of a communication terminal according to a first preferred embodiment of the present invention.

As illustrated in FIG. 1, a communication terminal 10 according to the present preferred embodiment preferably is a smartphone that includes an interface 30 that is accommodated in a housing 20. The interface 30 preferably is a graphical user interface including a touch panel.

Figure 2:
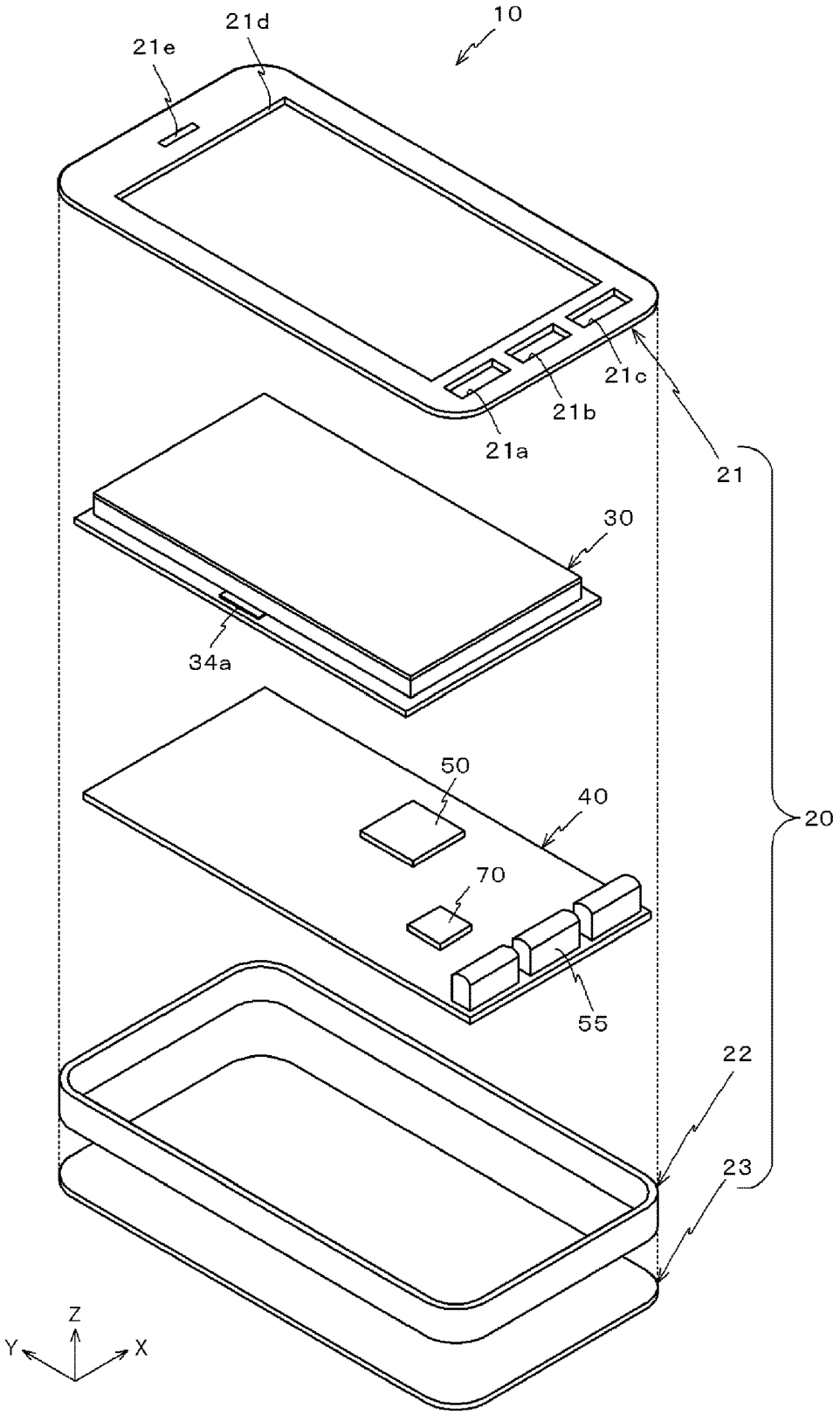
FIG. 2 is an exploded perspective view of the communication terminal.

As illustrated in FIG. 2, the communication terminal 10 includes a front panel 21, a frame 22, and a rear panel 23 that define the housing 20, the interface 30 that is accommodated in the housing 20, and a control board 40.

The front panel 21 preferably is a rectangular or substantially rectangular panel whose longitudinal direction is parallel or substantially parallel to the Y-axis direction. A rectangular or substantially rectangular opening 21*d* through which the interface 30 is to be exposed is provided in the front panel 21. Rectangular or substantially rectangular openings 21*a*, 21*b*, and 21*c* whose longitudinal directions are parallel or substantially parallel to the X-axis direction are provided adjacent to the opening 21*d*, which is provided in the front panel 21, on the −Y side so as to be equally or substantially equally spaced along the X axis. An opening 21*e* whose longitudinal direction is parallel or substantially parallel to the X-axis direction is adjacent to the opening 21*d*, which is provided in the front panel 21, on the +Y side. The front panel 21 can be made of glass or a resin.

The rear panel 23 preferably is a rectangular or substantially rectangular panel that is made of, for example, aluminum and whose longitudinal direction is parallel or substantially parallel to the Y-axis direction. The rear panel 23 preferably has a size that is the same or substantially the same as that of the front panel 21.

The frame 22 preferably is a frame-shaped member that is made of, for example, a metal such as aluminum or stainless steel. The front panel 21 is fixed on the frame 22, and the rear panel 23 is fixed to the bottom of the frame 22, so that the housing 20, which is illustrated in FIG. 1, is formed.

Figure 3:
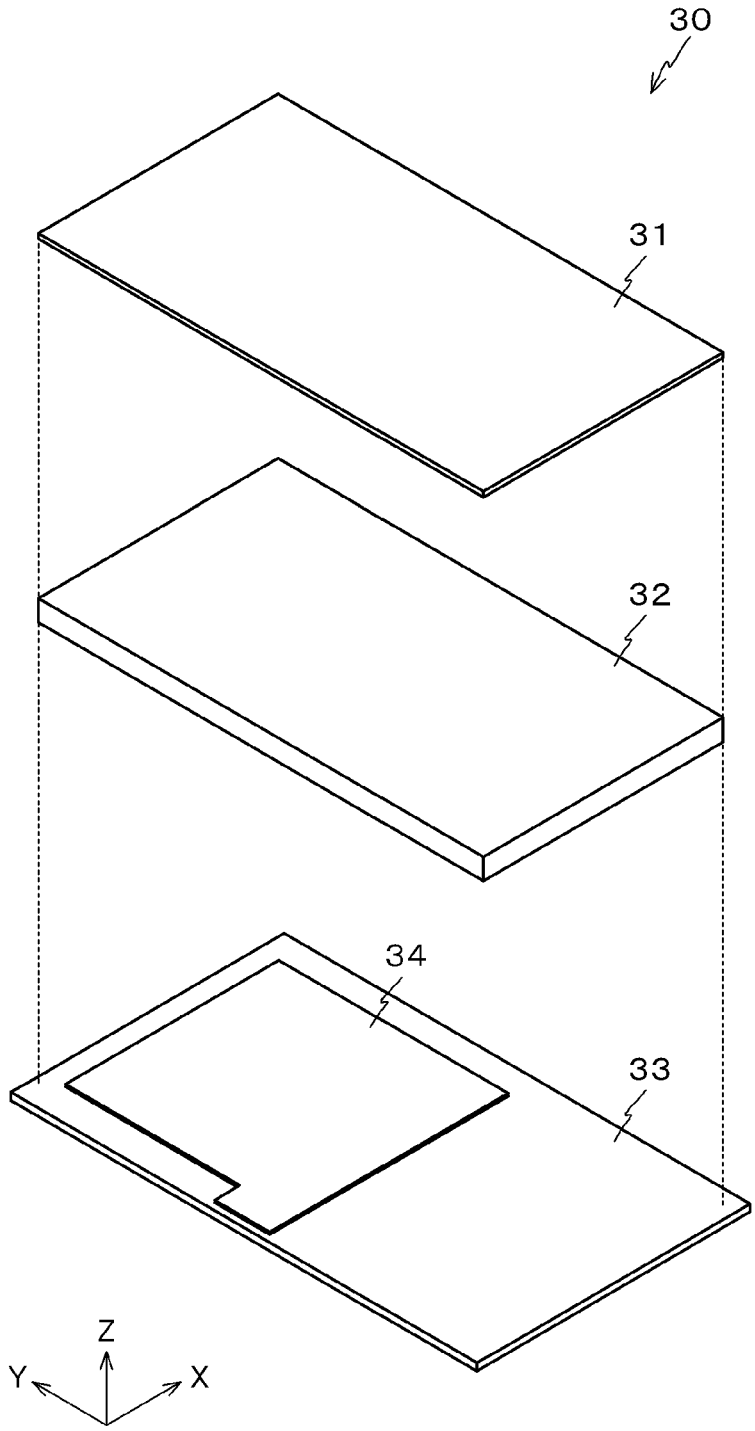
FIG. 3 is an exploded perspective view of an interface.

As illustrated in FIG. 3, the interface 30 preferably includes a touch panel 31, a display 32, a shield plate 33, and an antenna 34.

The display 32 preferably is a rectangular or substantially rectangular liquid crystal panel whose longitudinal direction is parallel or substantially parallel to the Y-axis direction. The display 32 preferably is a flat-panel display that uses a matrix driving method and includes transparent electrodes arranged in a matrix configuration. The display 32 includes a display screen that is exposed through the opening 21*d*, which is provided in the front panel 21. A surface of the display 32 on the +Z side is the display screen.

Figure 4:
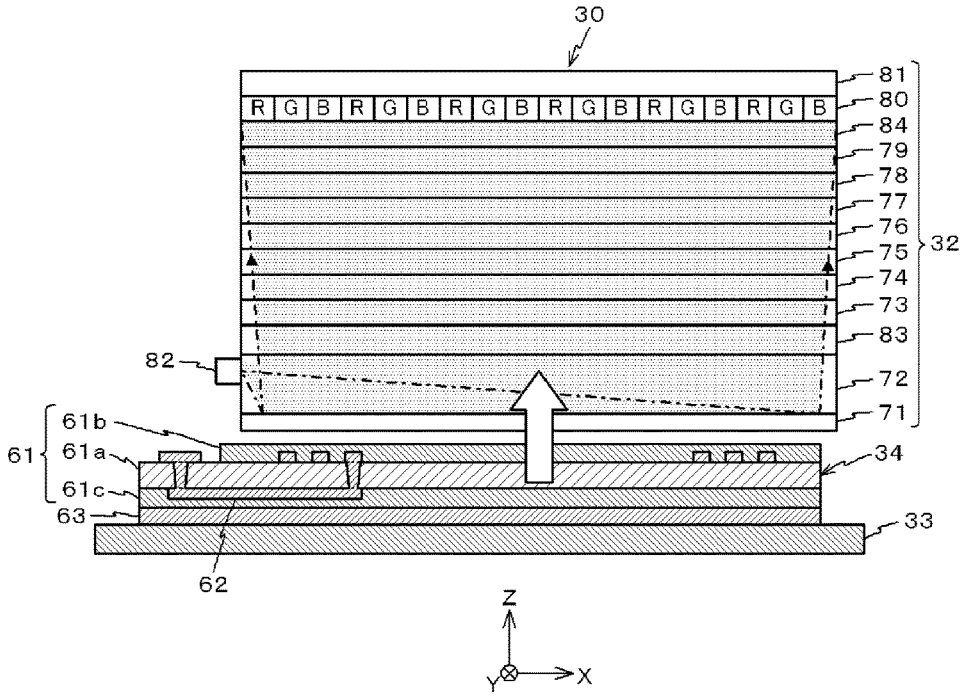
FIG. 4 is a diagram illustrating a display, an antenna, and a shield plate.

As illustrated in FIG. 4, the display 32 includes a glass substrate 72 that defines and functions as a light guide plate. In addition, the display 32 includes a polarizing plate 83, a glass layer 73, scanning electrodes 74, an alignment film 75, a liquid crystal layer 76, an alignment film 77, signal electrodes 78, a glass layer 79, a polarizing plate 84, a color filter 80, and a protective film 81 that are stacked on a top surface (surface on the +Z side) of the glass substrate 72 in this order. A reflective plate 71 that is made of, for example, polyethylene terephthalate (PET) is bonded to a bottom surface (surface on the −Z side) of the glass substrate 72, and an LED light source 82 is attached to a side surface of the glass substrate 72 on the −X side.

Figure 5:
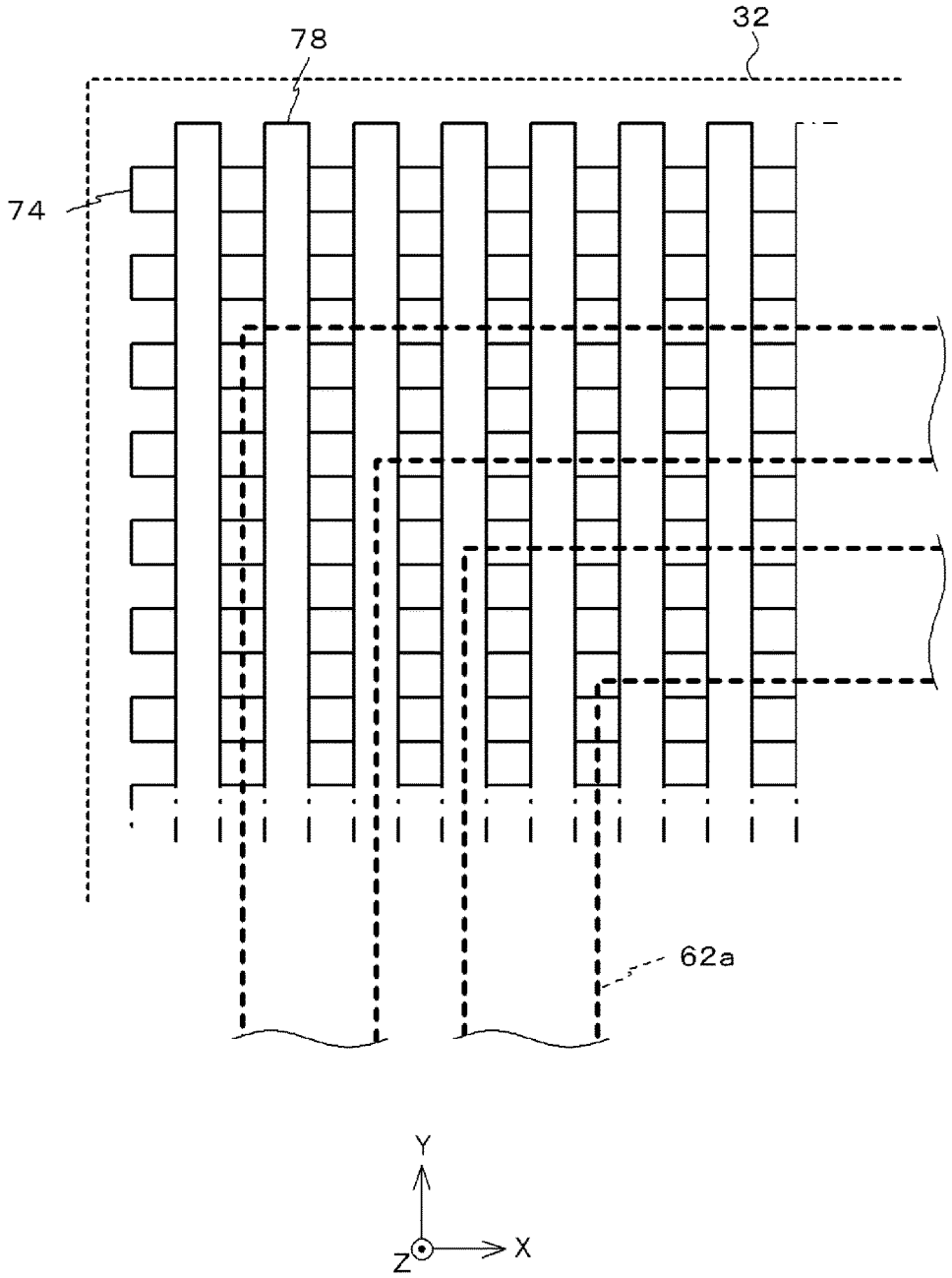
FIG. 5 is a diagram illustrating transparent electrodes.

As illustrated in FIG. 5, the electrodes of the display 32 include the scanning electrodes 74, which are equally or substantially equally spaced in the Y-axis direction, and the signal electrodes 78, which face the scanning electrodes 74 and are equally or substantially equally spaced in the X-axis direction.

In the display 32, which is configured as described above, when the LED light source 82 emits light, illuminating light is emitted from the LED light source 82. A portion of the illuminating light passes through the inside of the glass substrate 72 and then is incident on the reflective plate 71. The illuminating light that has been incident on the reflective plate 71 is scattered on a surface of the reflective plate 71 and eventually radiated onto the color filter 80.

The touch panel 31 preferably is, for example, an electrostatic capacitive touch panel. Similarly to the display 32, the touch panel 31 includes transparent electrodes that are arranged in a matrix form. As illustrated in FIG. 3, the touch panel 31 preferably has a size that is the same or substantially the same as that of the display screen of the display 32. The touch panel 31 is disposed on the display screen of the display 32.

The shield plate 33 is a metal plate whose longitudinal direction is parallel or substantially parallel to the Y-axis direction. The shield plate 33 is, for example, a metal member such as aluminum, galvanized steel sheet, or a stainless steel sheet. The shield plate 33 defines and functions as an electromagnetic shield that prevents electromagnetic waves that are generated by the display 32, which is disposed on the front surface (surface on the +Z side) of the shield plate 33, from entering, as noise, an electric circuit that is provided on the control board 40. In addition, the shield plate 33 also defines and functions as a reinforcing plate that protects the display 32 from an impact due to the communication terminal 10 falling or the like.

Figure 6:
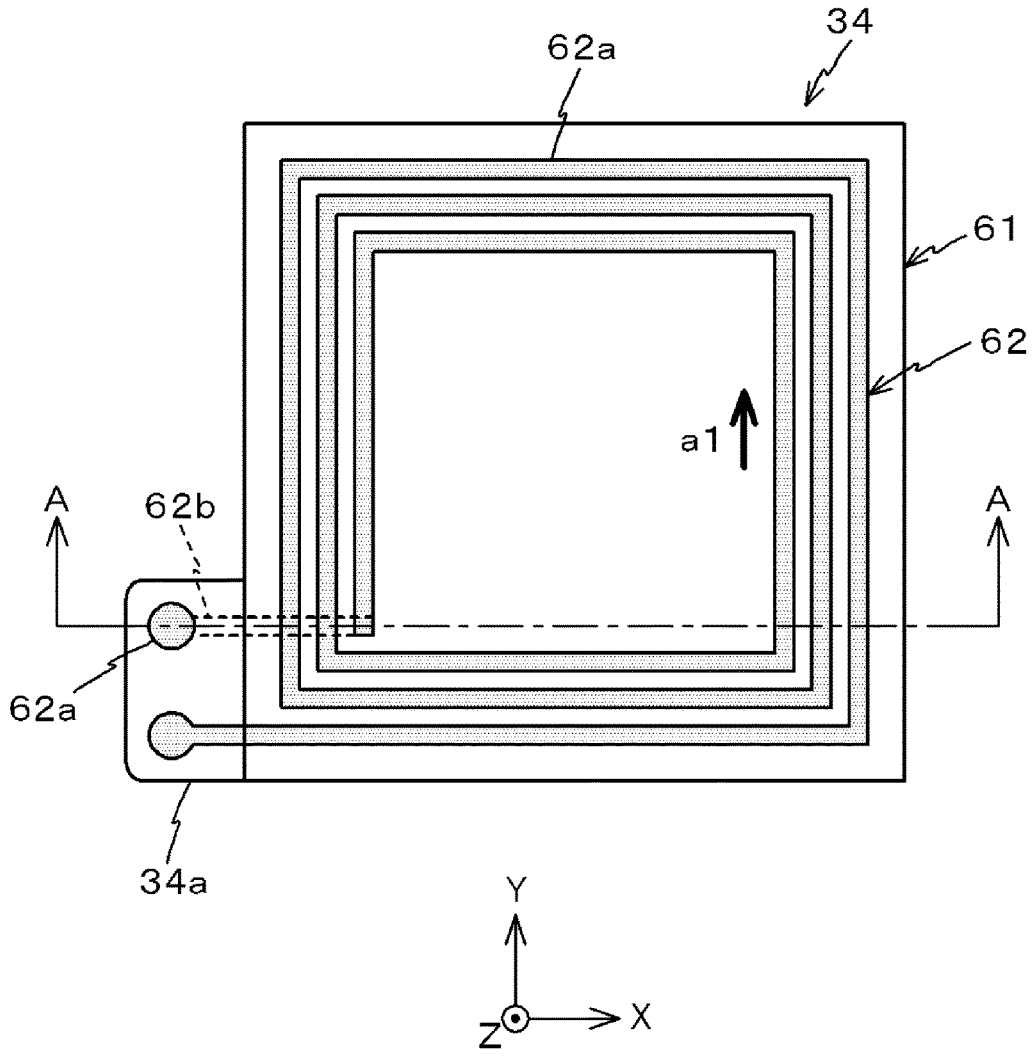
FIG. 6 is a plan view of the antenna.
Figure 7:
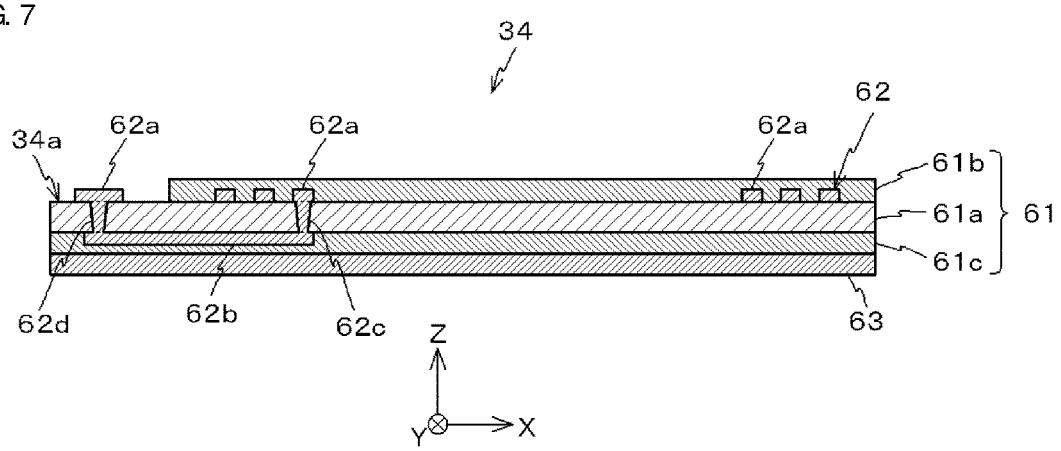
FIG. 7 is a sectional view of the antenna.

As illustrated in FIG. 6, the antenna 34 is a square or substantially square sheet-shaped component and includes an antenna coil 62 and a protective member 61 that protects the antenna coil 62. As illustrated in FIG. 7, which is a sectional view of the antenna 34 taken along line A-A of FIG. 6, the protective member 61 includes an insulating sheet 61*a* and solder resist layers 61*b* and 61*c* that are respectively provided on the top surface and the bottom surface of the insulating sheet 61*a*. In addition, a magnetic sheet 63 is attached to the bottom surface of the solder resist layer 61*c*.

The antenna coil 62 includes a wiring conductor 62*a* provided on the top surface of the insulating sheet 61*a*, a wiring conductor 62*b* provided on the bottom surface of the insulating sheet 61*a*, and via conductors 62*c* and 62*d* that connect the wiring conductors 62*a* and 62*b*. Note that, in FIG. 6, the wiring conductor 62*a* is illustrated by hatching.

The insulating sheet 61*a* is, for example, a polyimide sheet and includes a projecting portion 34*a* that is provided at a lower left corner of the insulating sheet 61*a* and that projects toward the −X side as illustrated in FIG. 6.

The wiring conductors 62*a* and 62*b* are formed preferably by patterning a copper foil that is attached to the insulating sheet 61*a*. The via conductors 62*c* and 62*d* are formed preferably by coating inner wall surfaces of through holes that extend through the insulating sheet 61*a* with a copper coating.

The solder resist layers 61*b* and 61*c* are formed preferably by applying a solder resist to the top and bottom surfaces of the insulating sheet 61*a*, on which the wiring conductors 62*a* and 62*b* and the via conductor 62*c* are formed, and curing the solder resist. As illustrated in FIG. 7, in the antenna 34, the top surface of the projecting portion 34*a*, which is included in the insulating sheet 61*a*, is exposed without being covered by the solder resist layer 61*b*.

The magnetic sheet 63 preferably is a sheet made of a non-conductive magnetic material such as ferrite. The magnetic sheet 63 is larger than the antenna coil 62 and covers the entire bottom surface of the antenna coil 62. Accordingly, the antenna coil 62 is not exposed through the magnetic sheet 63 toward a lower side (−Z side).

As illustrated in FIG. 3, the antenna 34, which is configured as described above, is disposed on the top surface of the shield plate 33. The display 32 is mounted on the top surface of the shield plate 33, and the touch panel 31 is mounted to be superposed with the display screen of the display 32, so that the touch panel 31, the display 32, the shield plate 33, and the antenna 34 are integrated with one another. As a result, the interface 30, which is illustrated in FIG. 2, is provided.

As illustrated in FIG. 2, in the interface 30, the projecting portion 34*a* of the insulating sheet 61*a* is in a state of being exposed. Thus, the antenna 34 is electrically connected to an electronic component that is mounted on the control board 40 via the wiring conductor 62*a* that is wired to the top surface of the projecting portion 34*a*, which is included in the antenna 34.

In the interface 30, when a current flows through the antenna coil 62, which is included in the antenna 34, in the direction of arrow a1 in FIG. 6, a magnetic flux that is indicated by an outlined arrow in FIG. 4 and that passes through the display 32 and the touch panel 31 is generated. Thus, information is transmitted to an external device that is located on the side on which the display screen of the display 32 is present by supplying to the antenna coil 62 a current that is modulated on the basis of the information to be transmitted.

Contrary to this, when a magnetic flux that is generated by the external device passes through the display 32 and the touch panel 31 and passes through the antenna coil 62, which is included in the antenna 34, a current flows through the antenna coil 62. Thus, information that is transmitted from the external device is received by demodulating the current, which flows through the antenna coil 62.

As illustrated in FIG. 2, the control board 40 is a wiring board whose longitudinal direction is parallel or substantially parallel to the Y-axis direction. Electronic components such as an RFIC 70, a CPU 50, and push buttons 55 are preferably mounted on the control board 40.

Figure 8:
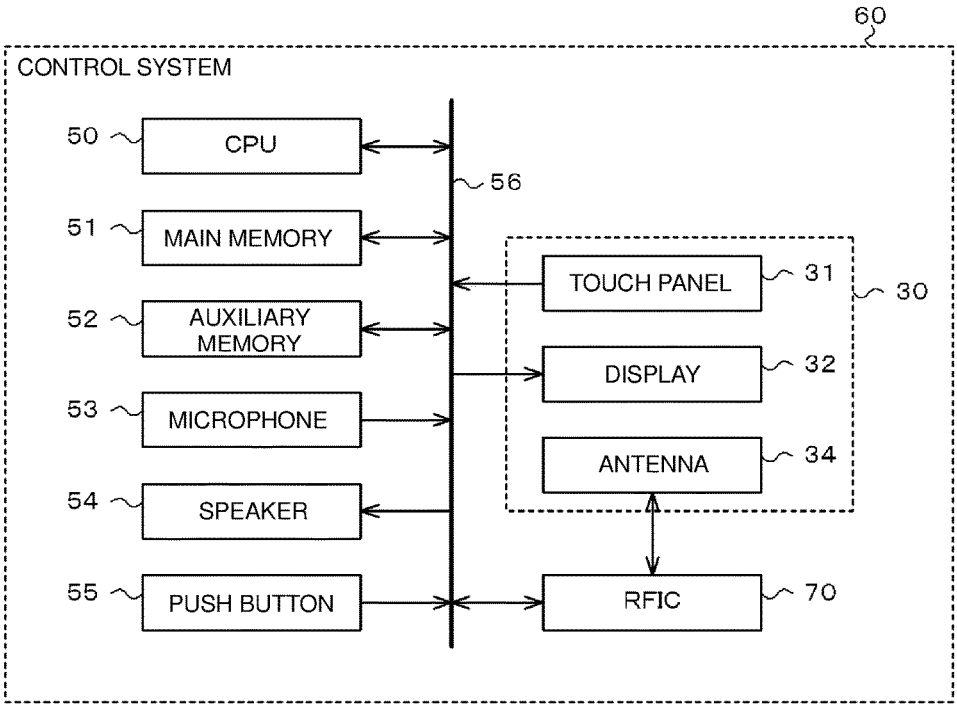
FIG. 8 is a block diagram of a control system.

In the present preferred embodiment, a control system illustrated in FIG. 8 includes the electronic components, which are mounted on the control board 40, and the interface 30. The control system 60 preferably includes the RFIC 70, the CPU 50, a main memory 51, an auxiliary memory 52, a microphone 53, a speaker 54, the push buttons 55, and a bus 56 that connects these units and the interface 30.

The RFIC 70 is a signal processing circuit configured to perform near field communication (NFC) and preferably is configured as a chip component. In other words, the RFIC 70 defines a communicator that communicates with an external device.

The main memory 51 includes a random access memory (RAM) or the like and is used as a work area by the CPU 50.

The auxiliary memory 52 includes a non-volatile memory such as a read only memory (ROM) or a semiconductor memory. Programs to be executed by the CPU 50, various parameters, and the like are stored in the auxiliary memory 52.

As illustrated in FIG. 2, the control board 40 and the above-described interface 30 are accommodated in the housing 20, which preferably includes the front panel 21, the frame 22, and the rear panel 23. As illustrated in FIG. 1, in the communication terminal 10, the touch panel 31 of the interface 30 and the key tops of the push buttons 55, which are mounted on the control board 40, are exposed through the openings 21*a* to 21*d* of the front panel 21.

Figure 9:
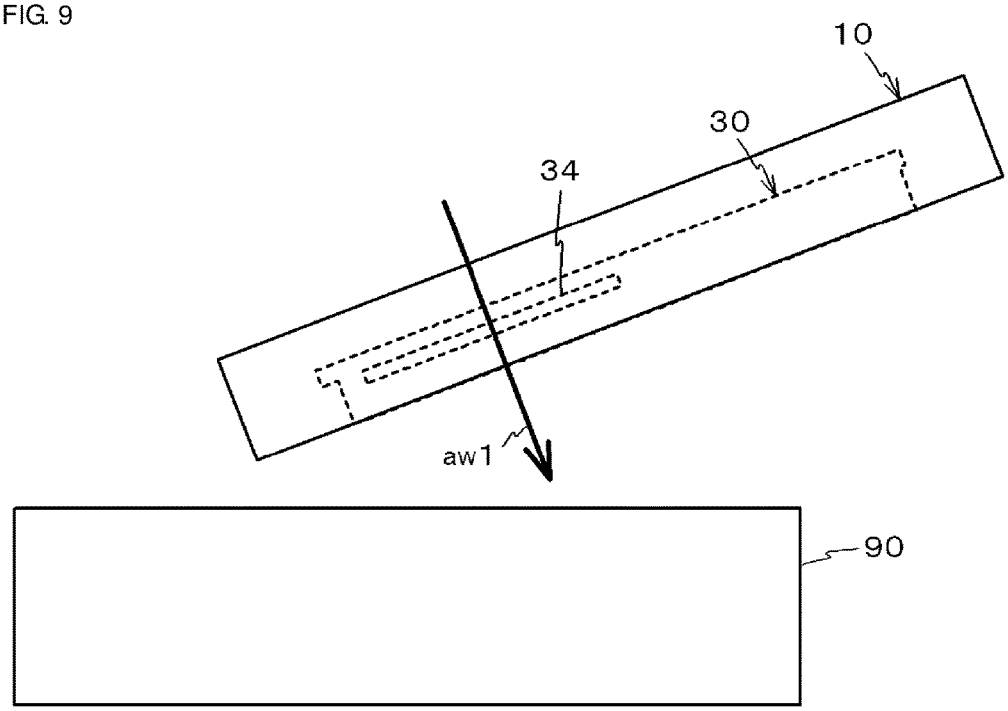
FIG. 9 is a diagram illustrating the state of the communication terminal communicating with an external device.

In the case where near field communication (NFC) is performed by using the communication terminal 10, as illustrated in FIG. 9, the front surface of the communication terminal 10 is brought close to an external device 90 with which the communication terminal 10 communicates. When the distance between the communication terminal 10 and the external device 90 is short enough for the communication terminal 10 and the external device 90 to communicate with each other, the RFIC 70 performs near field communication with the external device 90 via the antenna 34. When a current that has been modulated on the basis of information to be transmitted flows through the antenna coil 62 of the antenna 34, which is included in the communication terminal 10, a magnetic flux that is generated by the antenna 34 reaches the external device 90 as indicated by arrow aw1 in FIG. 9. In addition, when the communication terminal 10 receives a magnetic field from the external device 90, the magnetic flux is linked with the antenna coil 62, which is included in the antenna 34. As a result, the communication terminal 10 performs near field communication with the external device 90, which is located on the front surface side of the display 32, with good efficiency.

As described above, in the interface 30, which is included in the communication terminal 10 according to the present preferred embodiment, the antenna 34 is disposed on the bottom surface side of the reflective plate 71, which is included in the display 32. When the LED light source 82 irradiates the reflective plate 71, the antenna 34, which is disposed below the reflective plate 71, cannot be seen from the side on which the display screen (surface on the +Z side) of the display 32 is disposed.

Consequently, the antenna coil 62, which is included in the antenna 34, need not be formed of transparent electrodes and is capable of being made of various materials each having a high conductivity. Therefore, the antenna 34 having a high sensitivity is able to be manufactured at low cost, and as a result, near field communication is performed with the external device 90, which is located on the display screen side of the display 32, with good efficiency and without an increase in the manufacturing costs of the communication terminal 10.

In the present preferred embodiment, when the LED light source 82 irradiates the reflective plate 71, the antenna 34, which is disposed below the reflective plate 71, cannot be observed from the side on which the display screen of the display 32 is disposed. Thus, even if a versatile electronic component is used as the antenna 34, the visibility of the display 32 will not deteriorate. Accordingly, the structure of a device is simplified compared with the case where the antenna is disposed on the display screen side of the display 32, and as a result, the manufacturing costs of a communication device is reduced. In the case where the material out of which the antenna coil 62 is made is aluminum, the aluminum reflects light that is emitted by the LED light source 82 and leaked from the reflective plate 71 toward the side on which the shield plate 33 is present, and thus, the visibility of the antenna coil 62 from the side on which the display screen of the display 32 is disposed is reduced.

Figure 10:
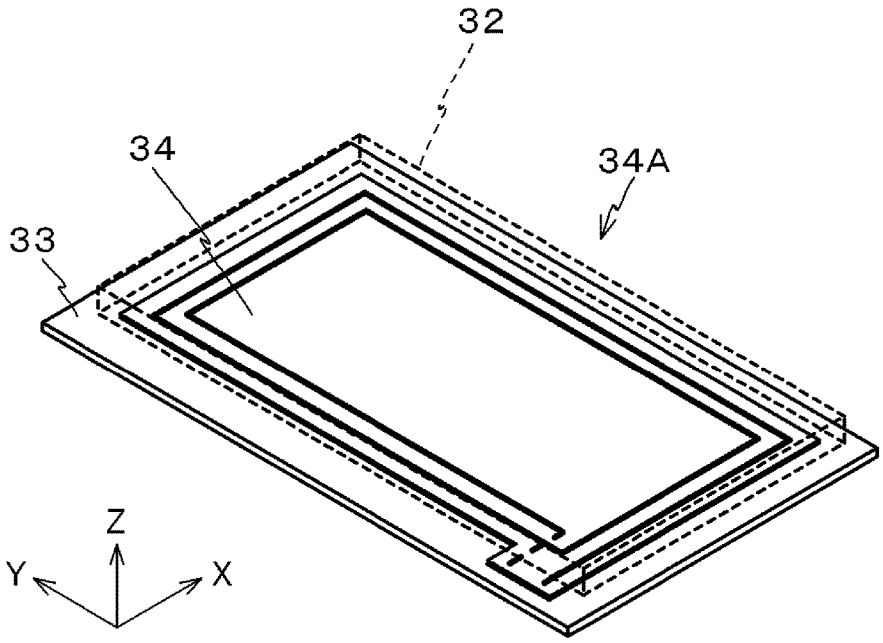
FIG. 10 is a diagram illustrating a modification of the antenna according to a preferred embodiment of the present invention.
Figure 11:
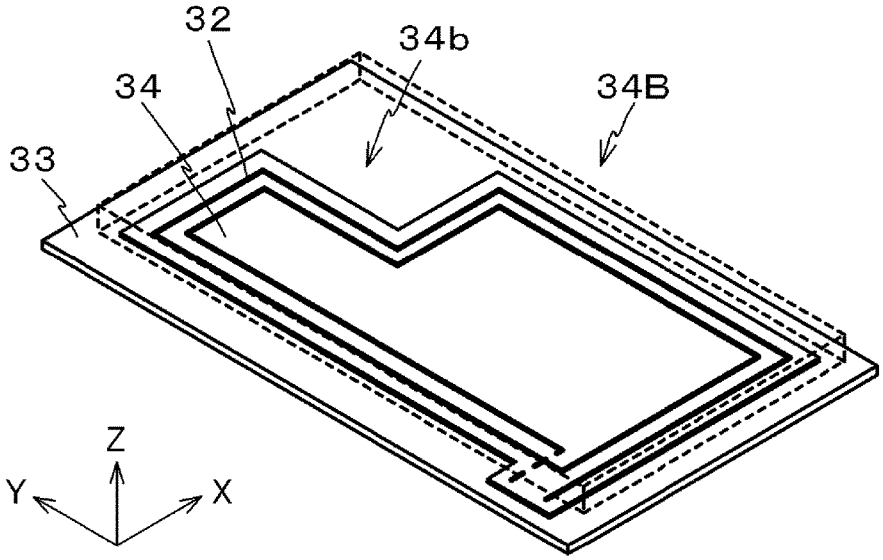
FIG. 11 is a diagram illustrating another modification of the antenna according to a preferred embodiment of the present invention.

In addition, in the present preferred embodiment, since the antenna 34, which is disposed below the reflective plate 71, cannot be seen from the side on which the display screen of the display 32 is disposed, the degree of freedom when designing the antenna 34 increases. Thus, for example, the interface 30 preferably may include an antenna having a size that is the same or substantially the same as that of the shield plate 33, such as an antenna 34A illustrated in FIG. 10. Alternatively, in the case where the antenna 34 interferes with an electronic component included in the display 32 or the like, a space 34*b* preferably is provided at any location as in an antenna 34B, which is illustrated in FIG. 11. As described above, the shape of the antenna is able to be designed without considering the visibility of the display 32.

In addition, it is not necessary to make an antenna coil having a thickness of about a few μm (e.g., about 3 μm) or smaller out of ITO, which is a transparent conductive material, or the like, and an antenna coil having a thickness of several tens of μm or larger can be made out of a metal material, such as copper or aluminum, having a high conductivity. Therefore, an antenna coil with a large reading range is able to be manufactured. As a result, near field communication on a display surface side of the communication terminal is performed.

In the present preferred embodiment, as illustrated in FIG. 5, the transparent electrodes of the display 32 include the scanning electrodes 74, which are equally or substantially equally spaced in the Y-axis direction, and the signal electrodes 78, which face the scanning electrodes 74 and are equally or substantially equally spaced in the X-axis direction. The scanning electrodes 74 and the signal electrodes 78 are each sufficiently thinner than the opening diameter of the wiring conductor 62*a*, which is included in the antenna coil 62. In addition, the scanning electrodes 74 and the signal electrodes 78 are isolated from each other with respect to direct current. Thus, an induced current that is generated as a result of a magnetic field acting on the scanning electrodes 74 and the signal electrodes 78 will not flow through the different transparent electrodes. In other words, a magnetic field generated by the antenna coil 62 will hardly be used as an induced current by these electrodes.

Scanning electrodes and signal electrodes that are used in a smartphone or the like each preferably have a width of about 3 μm and a length of about 40 mm, for example. Thus, in a frequency bandwidth used in near field communication, the resistances of the electrodes are large, and an induced current will not be generated in the electrodes. Even if an induced current is generated, the induced current will be used as heat because the resistances of the electrodes are large, and a magnetic field that cancels a magnetic field that is generated by an antenna coil will not be generated.

Accordingly, the magnetic flux generated by the antenna 34 reaches the external device 90, which is located on the display screen side of the display 32, via gaps between the scanning electrodes 74 and gaps between the signal electrodes 78 with only a small influence of the induced current generated in the scanning electrodes 74 and the signal electrodes 78 on the magnetic flux. Therefore, the communication terminal 10 performs near field communication with the external device 90 with good efficiency.

By configuring the scanning electrodes 74 and the signal electrodes 78 so as to be long and thin, the resistances of the scanning electrodes 74 and the signal electrodes 78 are significantly improved. In this case, generation of an induced current that circulates in the scanning electrodes 74 and the signal electrodes 78 is significantly reduced or prevented, and thus, the influence on a magnetic flux that passes through the display 32 is significantly reduced.

The electrostatic capacitive touch panel 31 also includes transparent electrodes that are equally or substantially equally spaced in the X-axis direction and transparent electrodes that are equally or substantially equally spaced in the Y-axis direction. Thus, the magnetic flux generated by the antenna 34 passes through the transparent electrodes. Therefore, even if the touch panel 31 is disposed on the front surface of the display 32, the communication terminal 10 performs near field communication with the external device 90, which is located on the display screen side of the display 32, with good efficiency.

Note that there are resistive touch panels. However, in the case where near field communication is performed by using such a resistive touch panel, loss due to an induced current is large. Therefore, it is desirable that an electrostatic capacitive touch panel be included.

In the present preferred embodiment, a user who carries the communication terminal 10 is able to perform near field communication with an external device via the display 32. Thus, the housing 20 of the communication terminal 10 preferably is made of a metal material such as aluminum or stainless steel. Consequently, the degree of freedom when designing the communication terminal 10 increases. The magnetic sheet 63, which is positioned below the antenna coil 62 when viewed from the display screen side, is covered by the antenna coil 62 and can hardly be seen. With this configuration, the antenna coil 62 and the shield plate 33 reflects the light that is emitted from the LED light source 82 and leaked from the reflective plate 71. Thus, the magnetic sheet 63 may preferably have a shape that matches or substantially matches the inner diameter and the external shape of the antenna coil 62. Electrodes of the antenna coil 62 may be spaced as closely as possible in such a manner as to cover the magnetic sheet 63 (shield member) by a metal antenna material of the electrodes.

Second Preferred Embodiment

A second preferred embodiment of the present invention will now be described with reference to the drawings. Note that components that are the same as or similar to those of the first preferred embodiment will be denoted by the same reference numerals, and descriptions thereof will be omitted.

Figure 12:
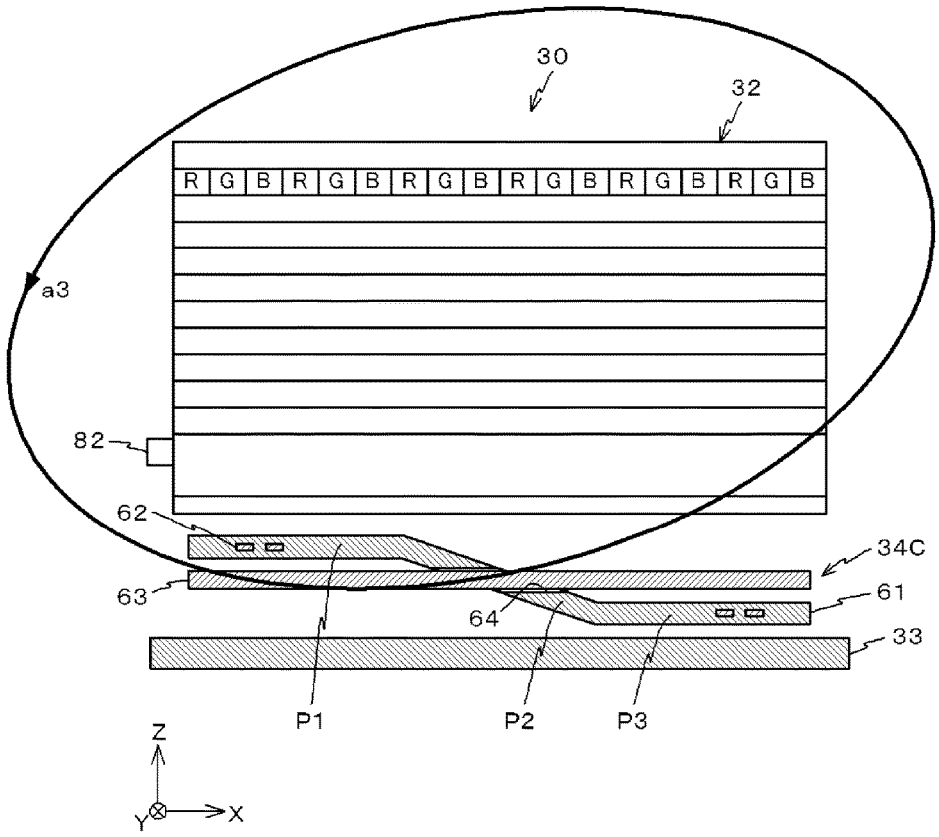
FIG. 12 is a diagram illustrating an interface according to a second preferred embodiment of the present invention.

A difference between the communication terminal 10 according to the present preferred embodiment and the communication terminal 10 according to the first preferred embodiment is that the interface 30 includes an antenna 34C as illustrated in FIG. 12. As illustrated in FIG. 12, the antenna 34C includes the protective member 61, the antenna coil 62, and the magnetic sheet 63 extending through the antenna coil 62.

Figure 13:
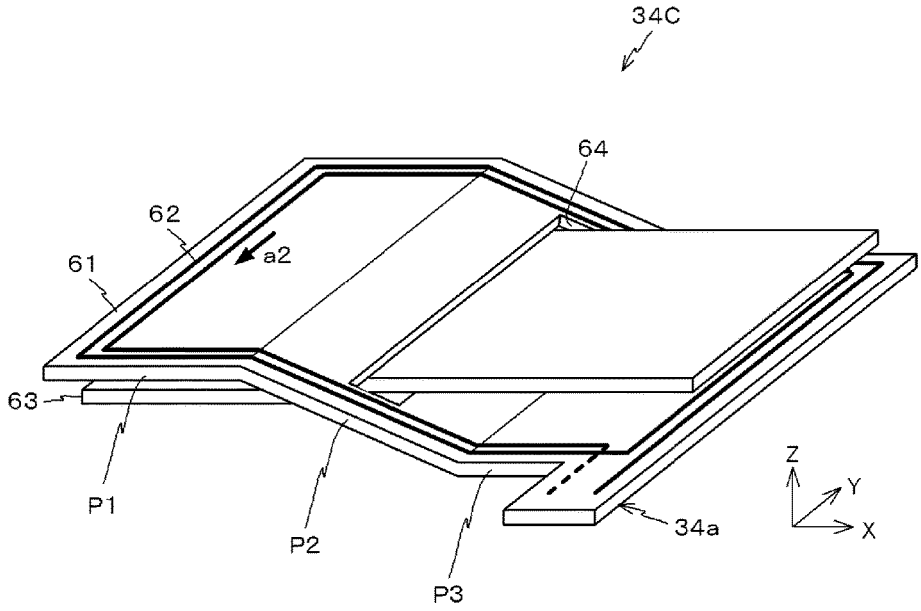
FIG. 13 is a perspective view of a coil.

As illustrated in FIG. 13, the protective member 61 is bent with the antenna coil 62 at two points and partitioned into three portions P1 to P3. The magnetic sheet 63 is received in a rectangular or substantially rectangular opening 64 that is located in the center portion P2 of the protective member 61 and whose longitudinal direction is parallel or substantially parallel to the Y-axis direction. In this state, the magnetic sheet 63 extends through the antenna coil 62 and is parallel or substantially parallel to the two portions P1 and P2 of the protective member 61, which are positioned at the opposite ends.

Figure 14:
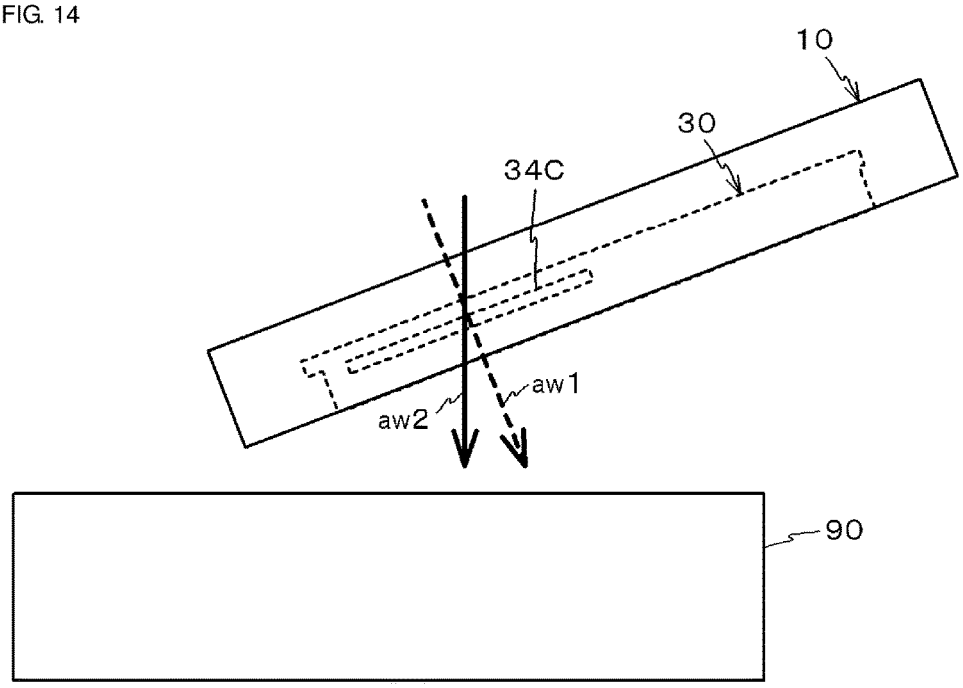
FIG. 14 is a diagram illustrating the state of the communication terminal communicating with an external device.

In the antenna 34C, which is configured as described above, when a current flows through the antenna coil 62 in the direction of arrow a2 in FIG. 13, an asymmetrical magnetic flux is generated in the direction of arrow a3 in FIG. 12 in the display screen of the display 32. As a result, the orientation of the antenna 34 changes. Thus, for example, in the case where the position of the communication terminal 10 is inclined with respect to the external device 90, as illustrated in FIG. 14, a magnetic flux that links to the external device 90 in a state of being perpendicular or substantially perpendicular to the external device 90, as indicated by arrow aw2, is generated.

Therefore, in the present preferred embodiment, even if the position of the communication terminal 10 is inclined with respect to the external device 90, near field communication is performed with the external device 90 with good efficiency. In addition, advantageous effects similar to those of the communication terminal 10 according to the first preferred embodiment are achieved.

In the present preferred embodiment, as illustrated in FIG. 13, the case where the protective member 61 is bent and the magnetic sheet 63 is not bent has been described. Contrary to this, only the magnetic sheet 63 may be bent to extend through the antenna coil 62 without bending the protective member 61. Alternatively, the magnetic sheet 63 may be caused to extend through the antenna coil 62 by bending both the protective member 61 and the magnetic sheet 63.

Figure 15:
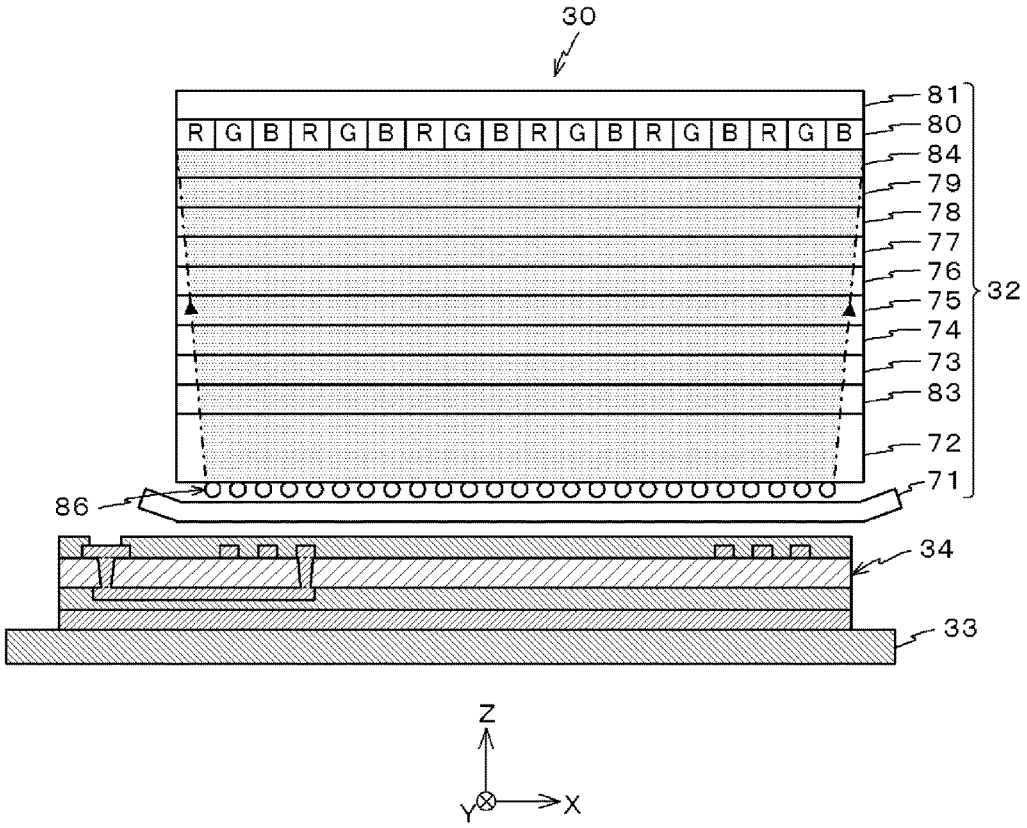
FIG. 15 is a diagram illustrating an interface according to a modification of a preferred embodiment of the present invention.

Although the preferred embodiments of the present invention have been described above, the present invention is not limited to the above-described preferred embodiments. For example, in the above-described preferred embodiments, as illustrated in FIG. 4, the illuminating light that enters from the side surface of the glass substrate 72 preferably is radiated onto the color filter 80 by being scattered by the reflective plate 71. The present invention is not limited to this configuration, and as illustrated in FIG. 15, cold-cathode tubes 86 may be disposed on the bottom surface of the glass substrate 72. In this case, the color filter 80 is uniformly irradiated by surface emission of the cold-cathode tubes 86, which are disposed on the entire bottom surface of the glass substrate 72. This improves the visibility of the display 32.

In one of the above-described preferred embodiments, the case where the protective member 61 preferably is bent at two points as illustrated in FIG. 12 has been described. The present invention is not limited to this configuration, and the protective member 61 may be bent at four points and partitioned into five portions P1 to P5 as in an antenna 34D illustrated in FIG. 16. In the antenna 34D, openings 64 and 65 are respectively provided in the two portions P2 and P4. The magnetic sheet 63 extends through both the openings 64 and 65 and is parallel or substantially parallel to the three portions P1, P3, and P5.

Figure 16:
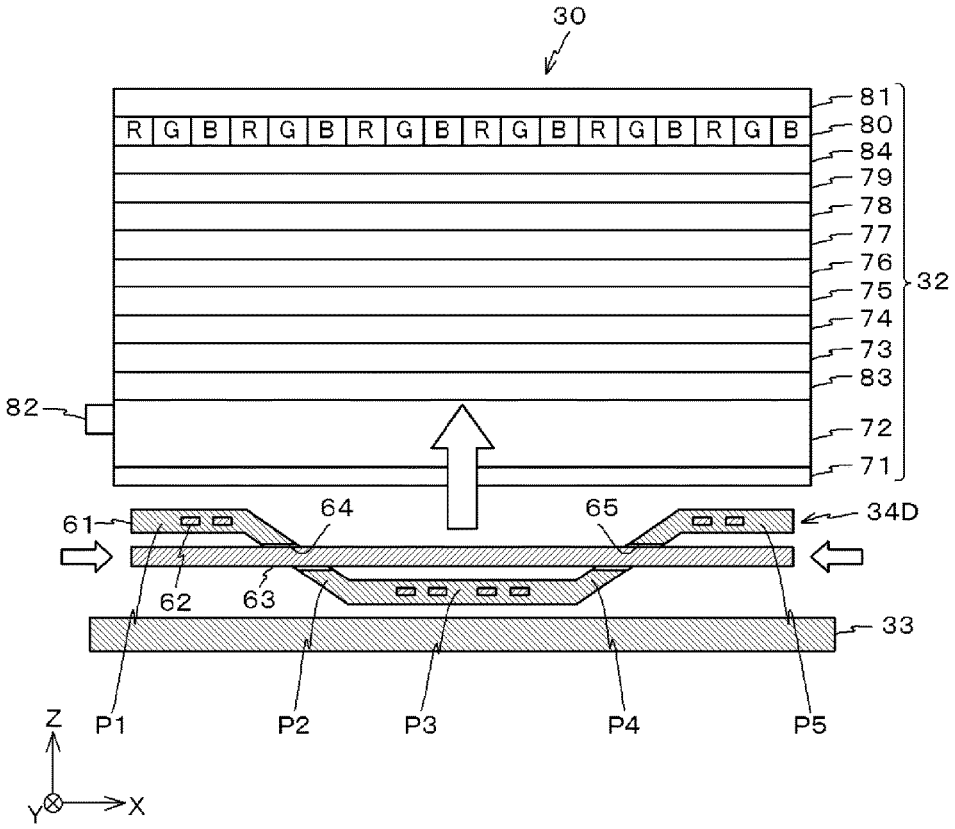
FIG. 16 is a diagram illustrating an interface according to another modification of a preferred embodiment of the present invention.
Figure 17:
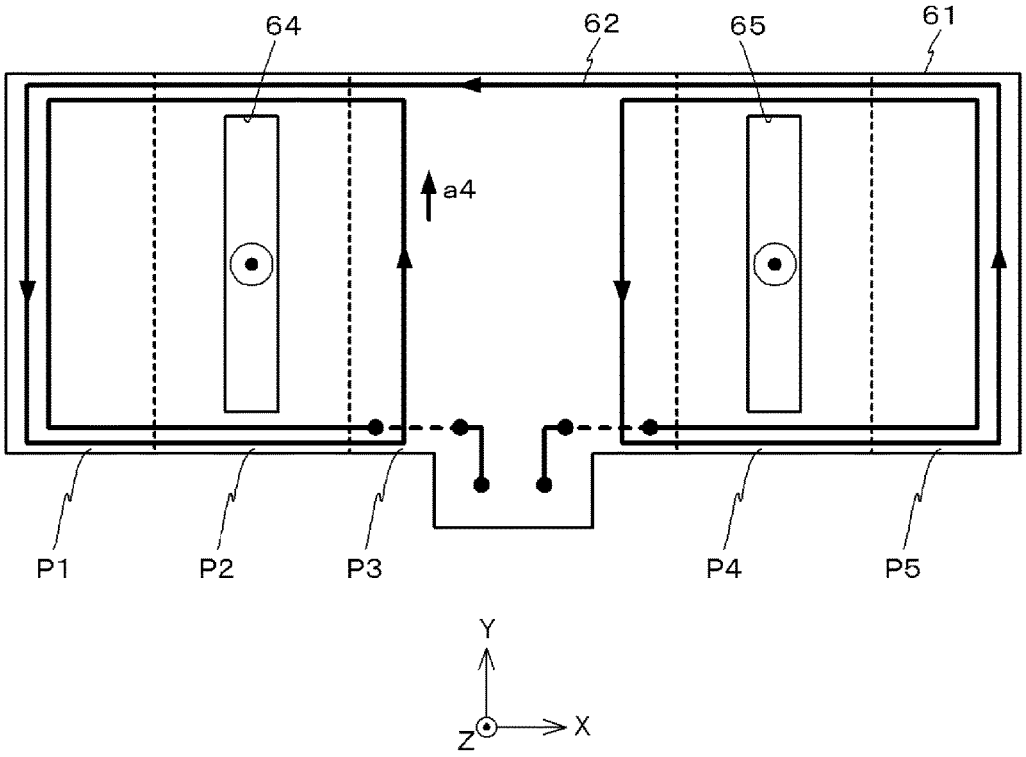
FIG. 17 is a plan view of a protective member.

As illustrated in FIG. 17, a portion of the antenna coil 62 provided on the protective member 61 extends around the opening 64, which is provided in the portion P2, in the same direction as that in which another portion of the antenna coil extends around the opening 65, which is provided in the portion P4. Thus, when a current flows through the antenna coil 62 in the direction of arrow a4, a magnetic flux extending from the distal side to the proximal side as viewed in the drawings is generated in the openings 64 and 65. Therefore, when near field communication is performed with the external device 90 via the antenna 34D, a magnetic flux that passes through the display 32 and the touch panel 31 as indicated by an outlined arrow in FIG. 16 and a magnetic flux that is parallel or substantially parallel to the display screen of the display 32 as indicated by another outlined arrow in FIG. 16 are generated. Consequently, even if the external device 90 is offset with respect to the front side of the display 32 in the X-axis direction, near field communication is performed with the external device 90 with good efficiency.

Figure 18:
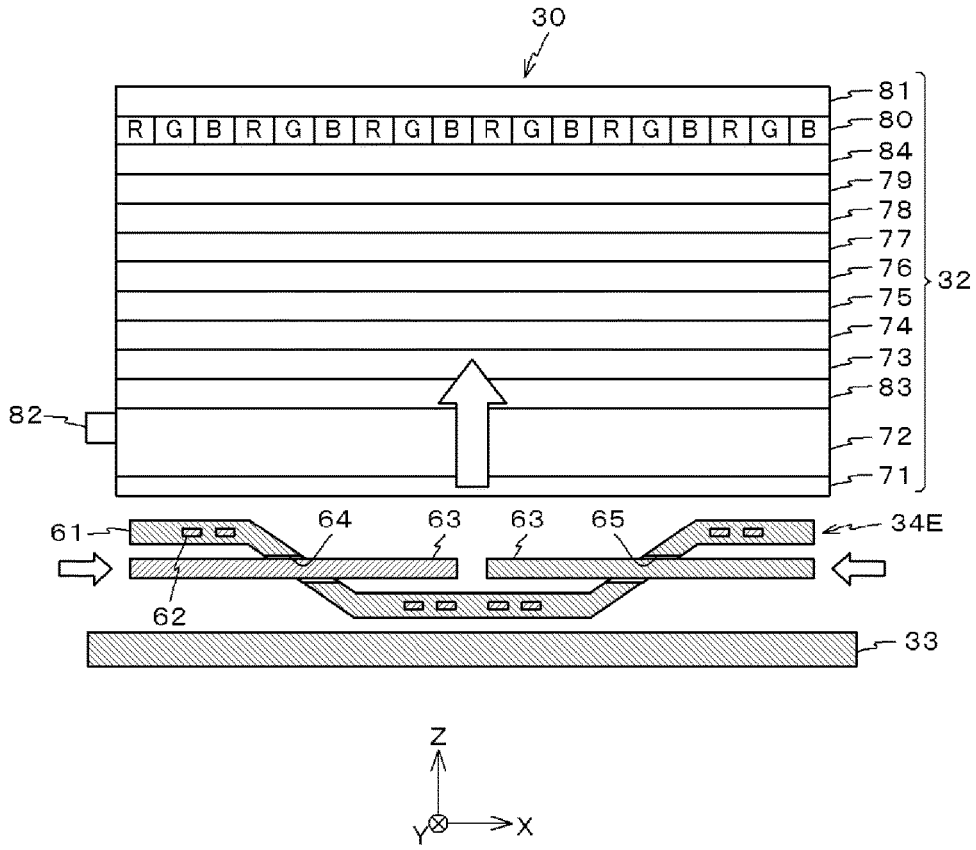
FIG. 18 is a diagram illustrating an interface according to another modification of a preferred embodiment of the present invention.

Note that in the description of the antenna 34D, the case where the single magnetic sheet 63 preferably extends through the openings 64 and 65 of the protective member 61 has been described. The present invention is not limited to this configuration, and individual magnetic sheets 63 may each extend through one of the openings 64 and 65 of the protective member 61 as in an antenna 34E, which is illustrated in FIG. 18.

In the above-described preferred embodiments, the case where the antenna coil 62 is preferably provided on the protective member 61 has been described. The present invention is not limited to this configuration, and the antenna coil 62 may be provided on the bottom surface of the reflective plate 71, which is included in the display 32, as illustrated in FIG. 19.

Figure 19:
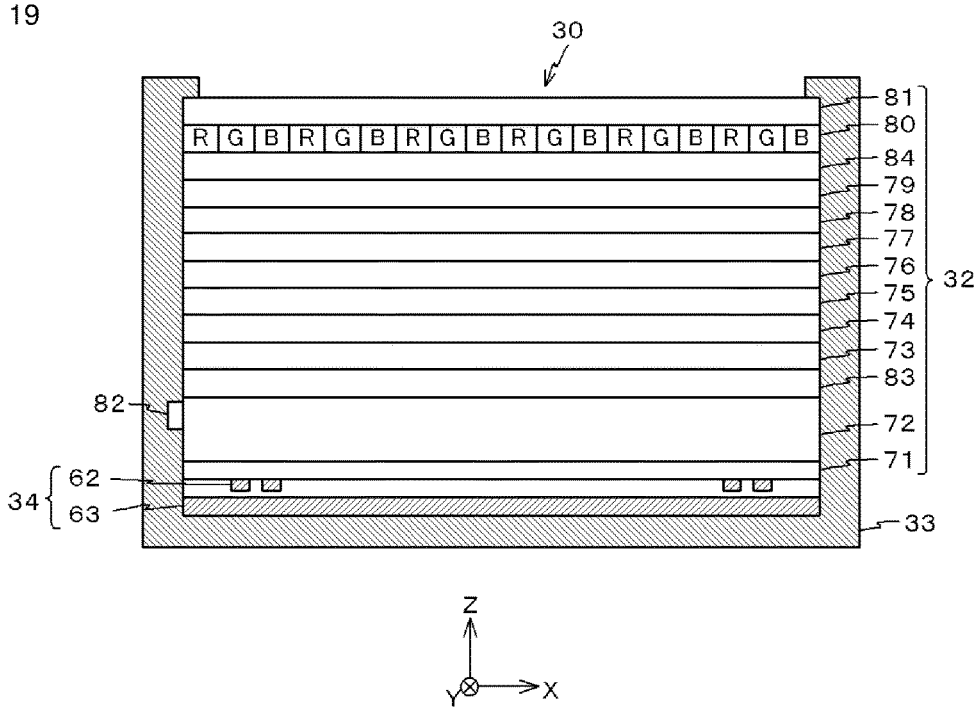
FIG. 19 is a diagram illustrating an interface according to another modification of a preferred embodiment of the present invention.

In the interface 30 illustrated in FIG. 19, four side surfaces of the display 32 are covered with the shield plate 33. In addition, the size of the antenna coil 62 is smaller than the size of the display 32, and the antenna coil 62 is arranged so as not to project from the display 32 when viewed from a display surface side (the +Z side).

In other words, when viewed in plan in the direction (Z-axis direction) perpendicular to the display surface, the antenna coil 62 is located inside the outer edge of the display 32. However, for example, a wiring line of the antenna coil 62 may be disposed outside the outer edge of the display 32.

Note that the four side surfaces of the display 32 may be covered with the shield plate 33 in, for example, the configurations illustrated in FIG. 4, FIG. 12, FIG. 15, FIG. 16, FIG. 18, FIG. 20, FIG. 22, and the like, other than the configuration illustrated in FIG. 19.

Figure 20:
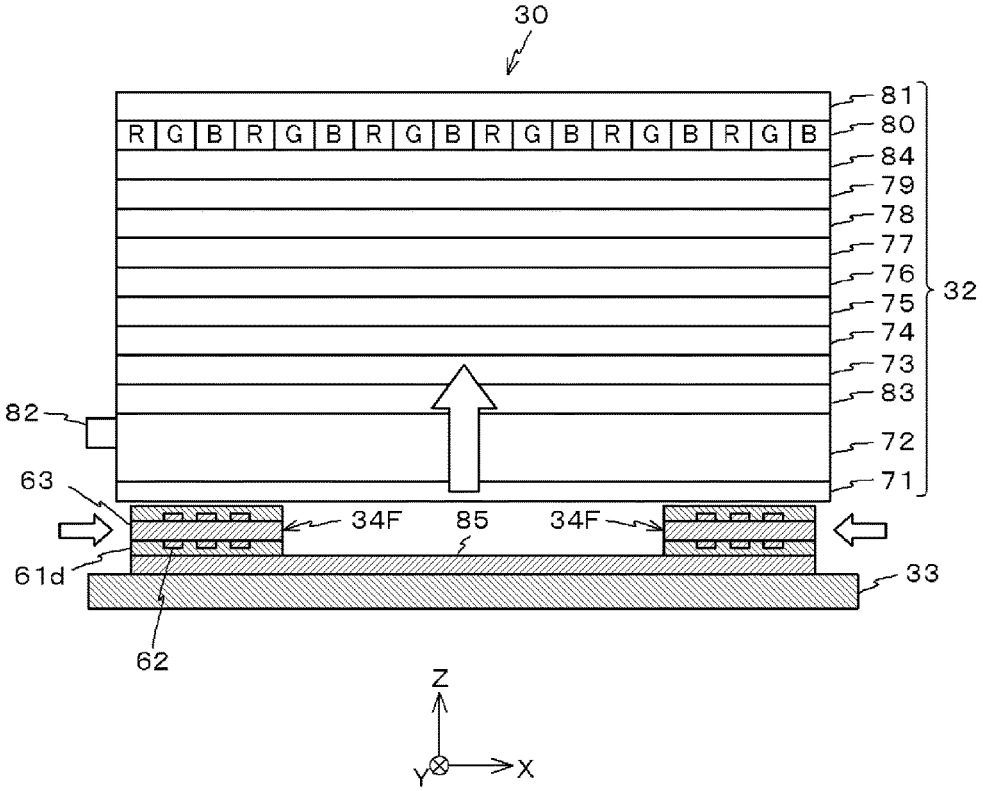
FIG. 20 is a diagram illustrating an interface according to another modification of a preferred embodiment of the present invention.

In one of the above-described preferred embodiments, the case where the antenna 34, which is included in the interface 30, preferably includes the antenna coil 62 provided therein, the antenna coil 62 being configured to generate a magnetic flux that is oriented in the Z-axis direction and that crosses the display screen of the display 32, has been described. The present invention is not limited to this configuration, and as illustrated in FIG. 20, the interface 30 may include antennas 34F, each of which generates a magnetic flux parallel or substantially parallel to the display screen of the display 32 in the antenna 34F. As illustrated in FIG. 20, each of the antennas 34F includes the magnetic sheet 63, the antenna coil 62 that is wound around the magnetic sheet 63, and a resin film 61*d* in which the antenna coil 62 is molded.

Figure 21:
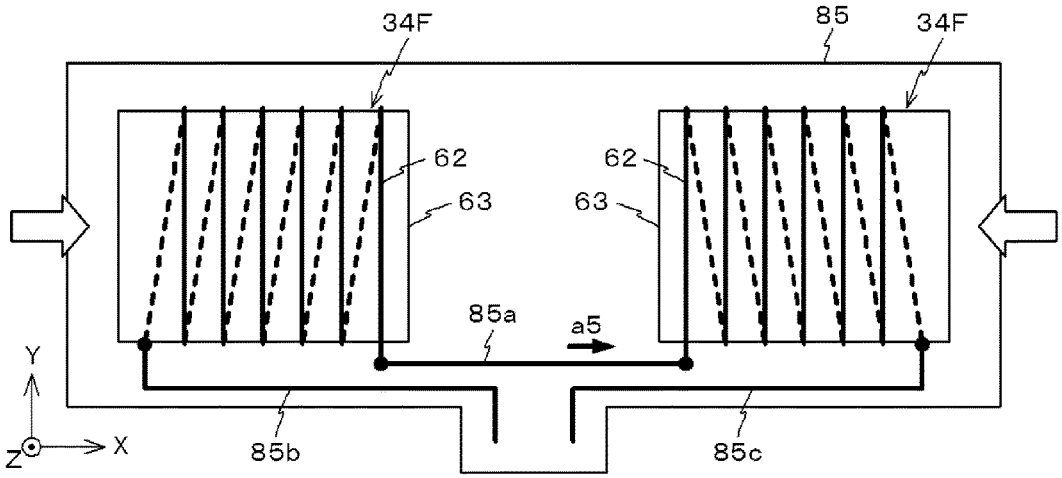
FIG. 21 is a plan view of a magnetic sheet.

As illustrated in FIG. 21, each of the antennas 34F is disposed on one of the end portions of a magnetic sheet 85, which is disposed on the top surface of the shield plate 33, in the X-axis direction. The antenna coils 62 of the antennas 34F are connected to each other by wiring conductors 85*a*, 85*b*, and 85*c* that are provided on the top surface of the magnetic sheet 85. When a current flows through the antenna coils 62 of the two antennas 34F in the direction of arrow a5 in FIG. 21, magnetic fluxes each of which is oriented in one of the directions of outlined arrows in FIG. 21 are generated in the antenna coils 62.

Accordingly, when near field communication is performed with the external device 90 via the antennas 34F, as indicated by outlined arrows in FIG. 20, a magnetic flux that passes through the display 32 and the touch panel 31 and a magnetic flux that is parallel or substantially parallel to the display screen of the display 32 are generated. Therefore, even if the external device 90 is offset with respect to the front side of the display 32 in the X-axis direction, near field communication is performed with the external device 90 with good efficiency.

In the above-described preferred embodiments and the above-described modifications, the case where the interface 30 preferably includes one or two antennas has been described. The present invention is not limited to this configuration, and the interface 30 may include a plurality of antennas.

Figure 22:
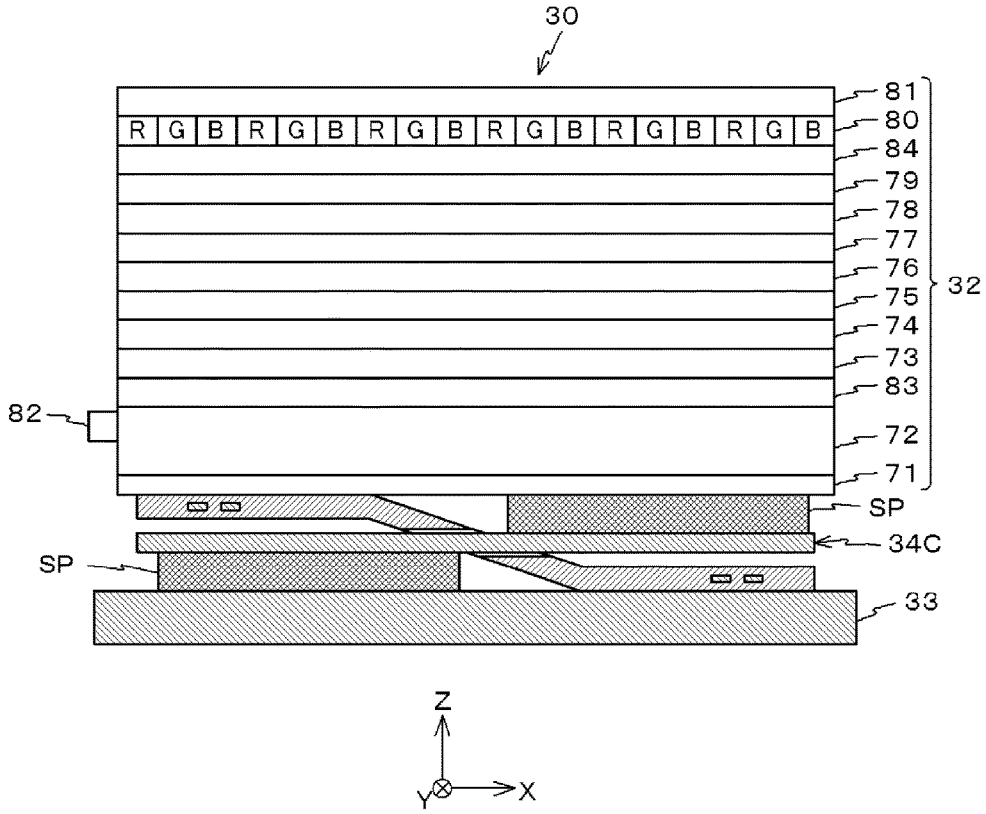
FIG. 22 is a diagram illustrating spacers.

In the above-described preferred embodiments and the above-described modifications, the case where the antenna preferably is directly provided on the shield plate 33 has been described. The present invention is not limited to this configuration, and as illustrated in FIG. 22, a spacer SP that is made of, for example, an ABS resin may be disposed between the antenna 34C and the shield plate 33 or between the antenna 34C and the reflective plate 71, which is included in the display 32. Alternatively, a thick portion that corresponds to the spacer SP may be provided on the shield plate 33.

In the above-described preferred embodiments, the case where the communication terminal 10 preferably is a smartphone has been described. The present invention is not limited to this configuration, and the communication terminal 10 may be a device having a communication function, such as a cellular phone, a tablet terminal, or a laptop computer not having a GUI, for example.

Although the display 32 preferably is a liquid crystal panel in the above-described preferred embodiments, the present invention is not limited to this configuration. The display 32 may be, for example, an organic EL display or a plasma display. That is to say, the display 32 may be a flat panel that uses a matrix driving method, representative examples of which are an active matrix driving method, a passive matrix driving method, and a simple matrix driving method.

In the case of a display that uses a passive matrix driving method, it is assumed that only a small amount of induced current that flows between a scanning electrode and a signal electrode will be generated. Thus, as described above, near field communication is performed with good efficiency without being influenced by the induced current that is generated between the electrodes. On the other hand, in the case of a display that uses an active matrix driving method, an element such as a pixel electrode is disposed between a scanning electrode and a signal electrode. Because of this, a space between the scanning electrode and the signal electrode is narrow, and in addition, an induced current may sometimes be generated between the electrodes. Therefore, various preferred embodiments of the present invention are especially useful in a communication terminal that includes a display that uses a passive matrix driving method.

In the above-described preferred embodiments, the case where the interface 30 preferably includes the touch panel 31, the display 32, the shield plate 33, and the antenna 34 has been described. The present invention is not limited to this configuration the interface 30 may only include the display 32, the shield plate 33, and the antenna 34.

In addition, the interface 30 need not have the GUI, which includes the touch panel 31 and the display 32, and may include a hardware keypad such as a numeric keypad, which is an alternative to the touch panel 31.

Figure 23:
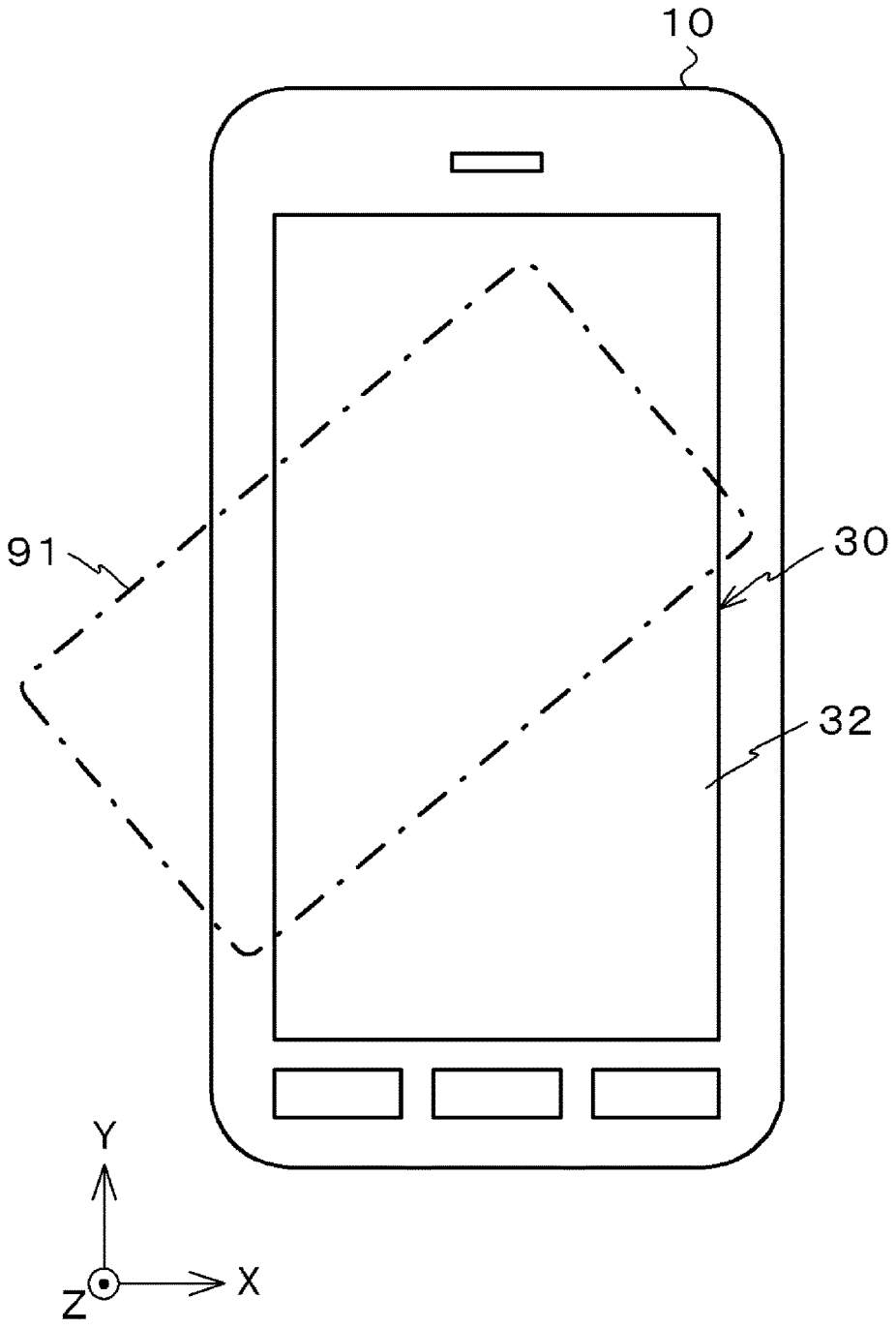
FIG. 23 is a diagram illustrating the state of the communication terminal communicating with an IC card.

In the above-described preferred embodiments, the case where the communication terminal 10 and the external device 90 preferably perform near field communication with each other has been described. The present invention is not limited to this configuration, and for example, as illustrated in FIG. 23, the communication terminal 10 may be used as a reader-writer that reads and writes information from and to an IC card 91.

Examples of the communication terminal 10 that is preferably used as the reader-writer for the IC card 91 include a smartphone and devices such as a tablet terminal, a laptop computer, and a television each having a liquid crystal panel.

Figure 24:
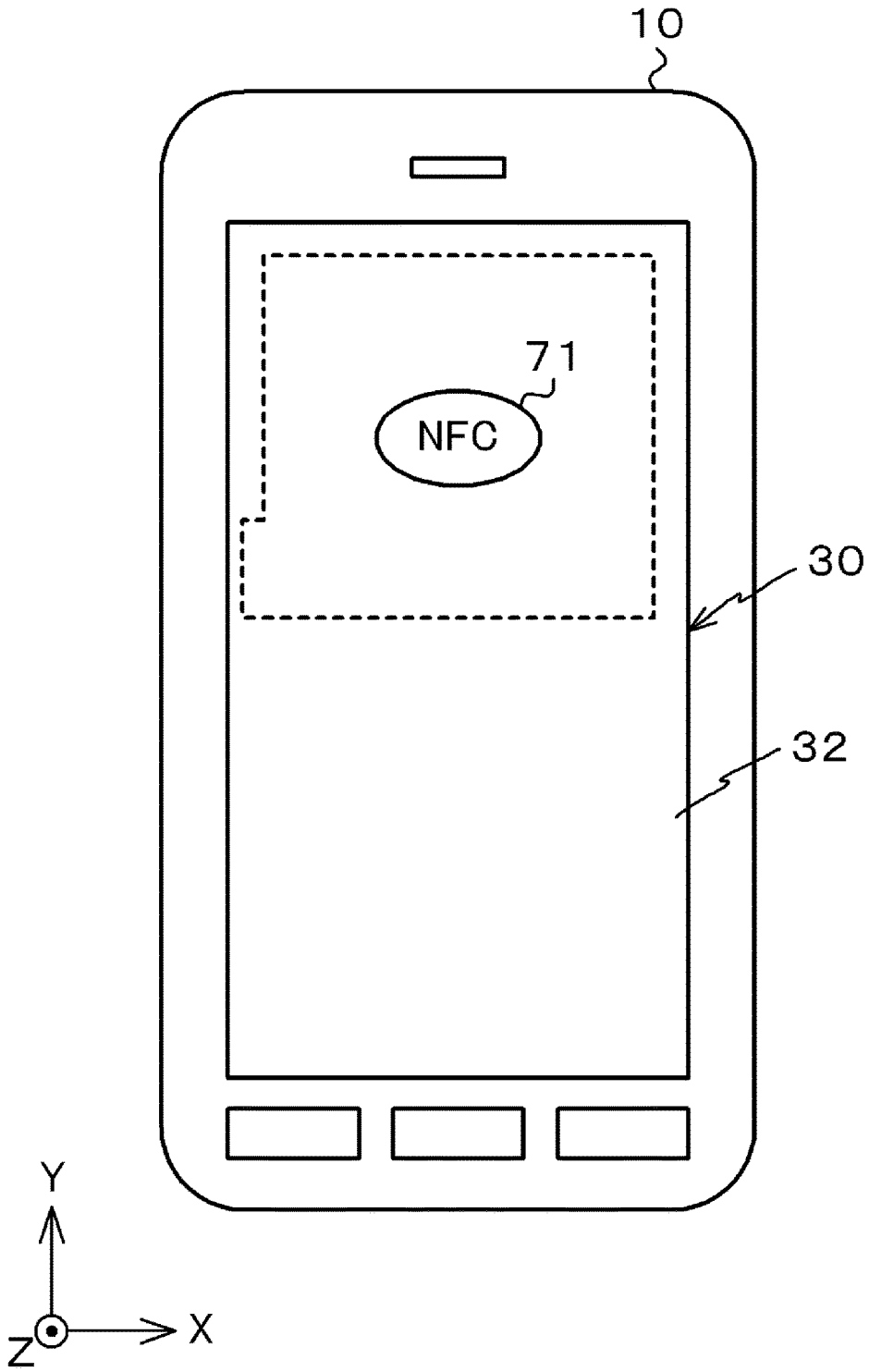
FIG. 24 is a diagram illustrating a mark that indicates a hot spot of the antenna.

The display device that is included in the communication terminal 10 may display, for example, a mark that indicates a hot spot of the antenna 34 as illustrated in FIG. 24.

Figure 25:
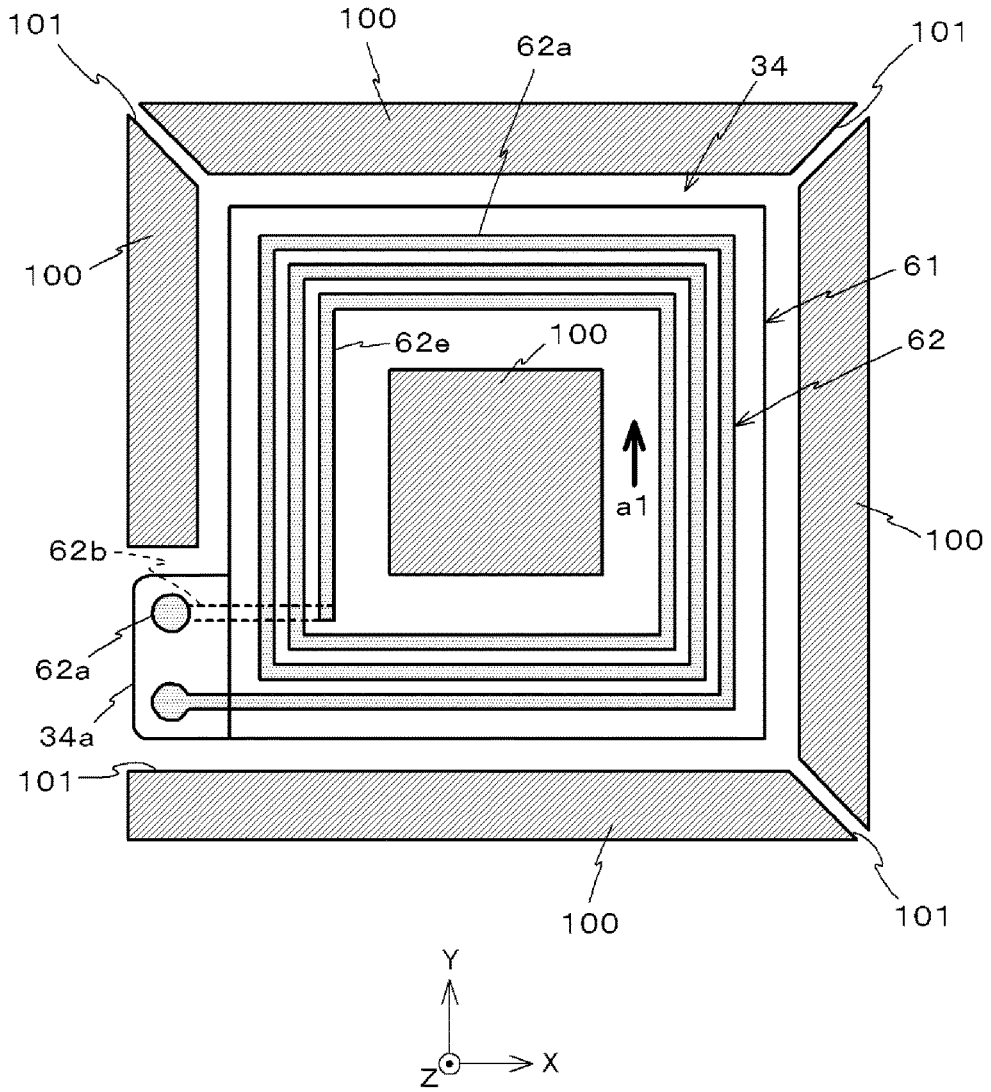
FIG. 25 is a plan view of an antenna of another modification of a preferred embodiment of the present invention.

In addition, as illustrated in FIG. 25, floating electrodes 100, each of which is preferably made of aluminum, may be arranged around the outer periphery of the antenna coil 62 and in an opening 62*e* of the antenna coil 62. The floating electrodes 100 are preferably provided on a layer on which the antenna coil 62 is formed (for example, on the insulating sheet 61*a* on the solder resist layer 61*b* side or on the solder resist layer 61*c*). As a result, light is reflected without blocking a magnetic field that is generated by the antenna coil 62, and a degree of unevenness in the intensity of the light when the display 32 is seen from the display screen side is reduced. In addition, even if the floating electrodes 100 are not made of aluminum, reasonable advantageous effects are obtained as long as the floating electrodes 100 are made of a conductive material that is the same as that out of which the antenna coil 62 is made. Note that, in FIG. 25, the wiring conductor 62*a* and the floating electrodes 100 are illustrated by hatching.

In this case, bringing the floating electrodes 100, which are used to reduce the degree of unevenness in the light intensity, too close to the antenna coil 62 causes undesirable coupling. Thus, in the case where one of the floating electrodes 100 is disposed in the opening 62*e* of the antenna coil 62, the floating electrode 100 is disposed in a center portion of the antenna coil 62 where the magnetic flux density is relatively low. In the case where one of the floating electrodes 100 is disposed around the outer periphery of the antenna coil 62, the floating electrode 100 preferably has a discontinuous ring-shaped configuration divided by division portions 101. As a result, a degree of deterioration of the antenna characteristics due to generation of an induced current is significantly reduced. Note that only one floating electrode 100 may be disposed either around the outer periphery of the antenna coil 62 or in the opening 62*e* of the antenna coil 62.

Figure 26:
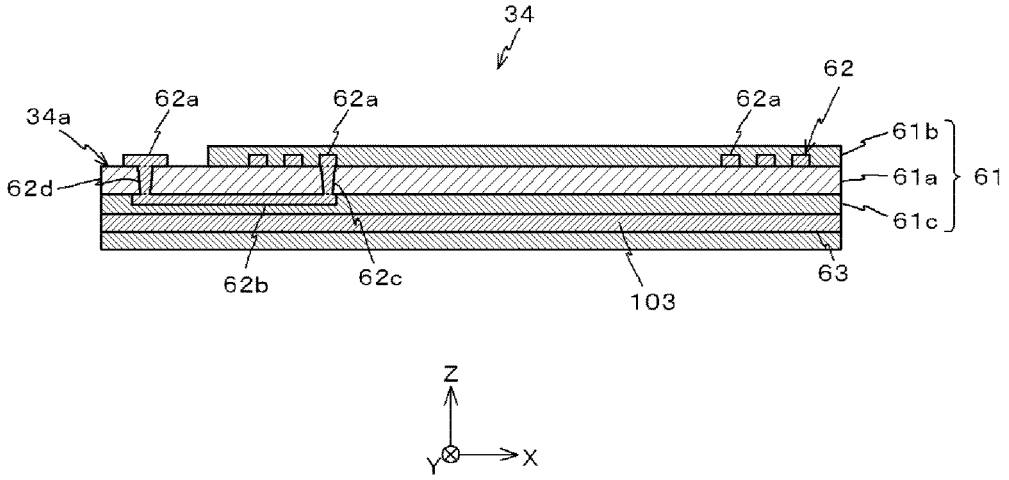
FIG. 26 is a sectional view of an antenna of another modification of a preferred embodiment of the present invention.

As illustrated in FIG. 26, a white or glossy insulating sheet 103 (insulating portion) may be attached to the magnetic sheet 63 on the side on which the antenna coil 62 is disposed. A magnetic material usually has a blackish color. Since such a blackish color absorbs the light emitted from the LED light source 82, there is a concern that the display screen of the display 32 may become dark. However, the display screen can be brightened by providing the insulating sheet 103. In other words, the light emitted from the LED light source 82 is reflected by the insulating sheet 103, so that the display screen can be brightened by using a small amount of power. Note that an insulating portion that is formed by applying a white or glossy insulating coating material to the magnetic sheet 63 on the side on which the antenna coil 62 is disposed may be provided instead of the insulating sheet 103.

Note that, in the case where a sintered compact is used as the magnetic sheet 63, the sintered compact is preferably covered with the insulating sheet 103 in order to prevent a crack from occurring in the sintered compact. As a result, preventing the occurrence of a crack in the sintered compact and brightening the display screen can be both achieved.

Figure 27:
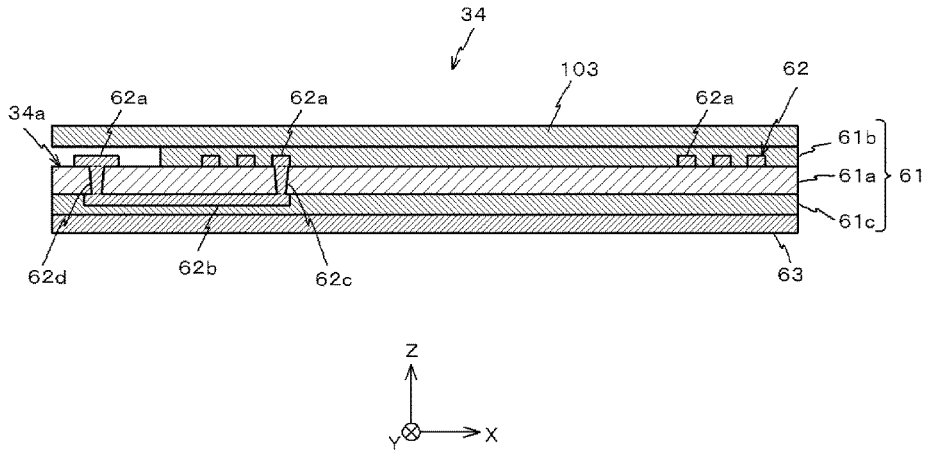
FIG. 27 is a sectional view of an antenna of another modification of a preferred embodiment of the present invention.

As illustrated in FIG. 27, the white or glossy insulating sheet 103 (insulating portion) may be attached on the top surface of the antenna coil 62. Alternatively, an insulating portion may be formed by applying a white or glossy insulating coating material to the top surface of the solder resist layer 61*b*.

Figure 28:
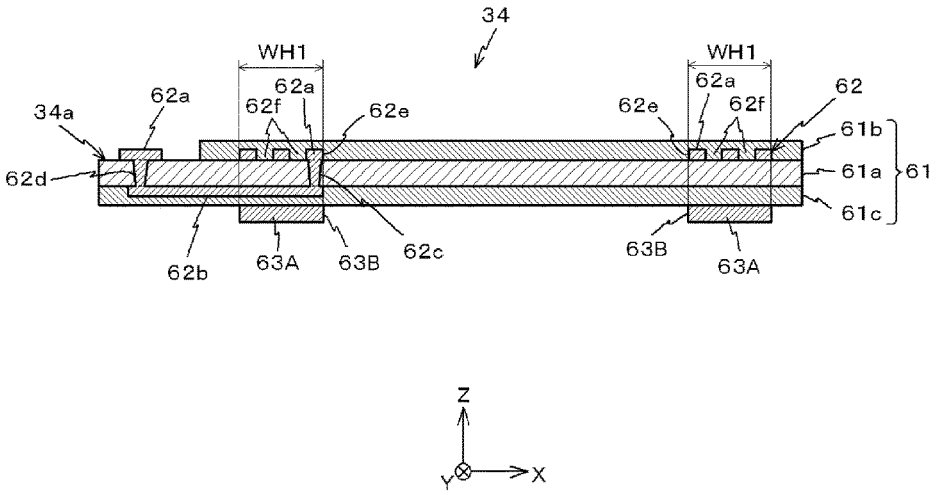
FIG. 28 is a sectional view of an antenna of another modification of a preferred embodiment of the present invention.

Although, as illustrated in FIG. 7, the magnetic sheet 63 preferably covers the entire bottom surface of the antenna 34 in the above-described preferred embodiments, the present invention is not limited to this configuration. Instead of the magnetic sheet 63 illustrated in FIG. 7, as illustrated in FIG. 28, a magnetic member 63A having a width that is the same or substantially the same as a width WH1 of a region in which the antenna coil 62 is provided when viewed in plan may be provided. An opening 63B is provided in a portion of the magnetic member 63A corresponding to the opening 62*e* of the antenna coil 62. In other words, the magnetic member 63A is disposed at a position superposed with the region in which the antenna coil 62 is located when viewed in plan. Consequently, when viewed from the side on which the display screen of the display 32 is disposed, the magnetic member 63A is covered with the antenna coil 62 excluding gaps 62*f* (gaps between portions of a coil), which are gaps between portions of the wiring conductor 62*a* of the antenna coil 62. Therefore, the likelihood that the light emitted from the LED light source 82 will be absorbed by the magnetic member 63A is significantly reduced.

In addition, by making the antenna coil 62 and a back chassis of the communication terminal 10 out of the same material, the degree of unevenness in the light intensity is significantly reduced.

Various modifications may be made within the broad spirit and scope of the present invention. In addition, the above preferred embodiments are described for the sake of explanation of the present invention and do not limit the present invention.

This application is based on Japanese Patent Application No. 2012-259739 filed on Nov. 28, 2012. The specification, claims, and drawings of Japanese Patent Application No. 2012-259739 are incorporated in their entirety herein by reference.

Interfaces of preferred embodiments of the present invention are suitable for transmission and reception of information to and from an external device. Communication devices of preferred embodiments of the present invention are suitable for near field communication with an external device.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An interface comprising:

a display device configured to use a matrix driving method and including a display screen on a first side of the display device;

a metal member that is disposed on a second side of the display device;

a magnetic member; and an antenna coil that is disposed between the display device and the metal member and positioned near one end of the display device when viewed in plan from a side on which the display screen is disposed; wherein the magnetic member extends through the antenna coil in a direction in which the display screen extends;

the antenna coil includes a first conductor portion and a second conductor portion; and the first conductor portion and the second conductor portion do not overlap with each other when viewed in plan from the side on which the display screen is disposed.

2. The interface according to claim 1, wherein the antenna coil is not to be exposed when viewed from the side on which the display screen of the display device is disposed.

3. The interface according to claim 1, wherein the display device includes a light source.

4. The interface according to claim 1, wherein the magnetic member is disposed between one of the first and second conductor portions and the metal member.

5. The interface according to claim 1, wherein the antenna coil is configured to generate a magnetic flux that crosses the display screen.

6. The interface according to claim 1, further comprising a spacer configured to eliminate a difference in level between the antenna coil and the magnetic member.

7. The interface according to claim 1, wherein the antenna coil is configured to generate a magnetic flux that is parallel or substantially parallel to the display screen.

8. The interface according to claim 1, further comprising a plurality of the antenna coils.

9. The interface according to claim 1, further comprising a touch panel that is superposed with the display screen.

10. The interface according to claim 9, wherein the touch panel is an electrostatic capacitive touch panel.

11. The interface according to claim 1, further comprising a floating electrode that is disposed in at least one of a region around an outer periphery of the antenna coil and a region in an opening of the antenna coil.

12. The interface according to claim 1, further comprising an insulating portion that is positioned between the antenna coil and the metal member or between the antenna coil and the display device.

13. The interface according to claim 1, wherein the magnetic member is disposed at a position that is superposed with a region in which the antenna coil is located when viewed in plan.

14. The interface according to claim 1, wherein the antenna coil does not include transparent electrodes.

15. A communication device comprising:

the interface according to claim 1; and a communicator configured to communicate with an external device via the antenna coil, which is included in the interface.

16. The communication device according to claim 15, wherein the communicator is configured to perform near field communication with the external device.

17. The communication device according to claim 15, wherein the communication device is one of a phone and a computer.

18. The communication device according to claim 15, wherein the antenna coil does not include transparent electrodes.

* * * * *